United States Patent [19]

Iwasa et al.

[11] Patent Number: 4,524,130

[45] Date of Patent: Jun. 18, 1985

[54] SILVER HALIDE COLOR PHOTOGRAPHIC LIGHT-SENSITIVE MATERIALS

[75] Inventors: Yasuo Iwasa; Shingo Ishimaru, both of Kanagawa, Japan

[73] Assignee: Fuji Photo Film Co., Ltd., Kanagawa, Japan

[21] Appl. No.: 572,046

[22] Filed: Jan. 19, 1984

[30] Foreign Application Priority Data

Jan. 19, 1983 [JP] Japan ..... 58-7153

[51] Int. Cl.[3] ..... G03C 1/46

[52] U.S. Cl. ..... 430/505; 430/544; 430/553; 430/555; 430/557; 430/558; 430/957

[58] Field of Search ..... 430/505, 544, 957, 553, 430/555, 557, 558

[56] References Cited

U.S. PATENT DOCUMENTS

| | | | |
|---|---|---|---|
| 4,171,223 | 10/1979 | Odenwalder et al. | 430/544 |
| 4,171,975 | 10/1979 | Kato et al. | 430/957 |
| 4,276,372 | 6/1981 | Wernicke et al. | 430/505 |
| 4,306,015 | 12/1981 | Haylett | 430/544 |
| 4,315,070 | 2/1982 | Ranz et al. | 430/544 |
| 4,348,474 | 9/1982 | Scheerer et al. | 430/506 |
| 4,414,308 | 11/1983 | Hamada | 430/544 |
| 4,461,826 | 7/1984 | Yamashita et al. | 430/544 |

*Primary Examiner*—J. Travis Brown

*Attorney, Agent, or Firm*—Sughrue, Mion, Zinn Macpeak & Seas

[57] ABSTRACT

A silver halide color photographic light-sensitive material is disclosed. The material is comprised of a support base having a plurality of silver halide emulsion layers positioned thereon. The material includes at least one silver halide emulsion layer having a particular sensitivity and color sensitivity, and a second silver halide emulsion layer having the same color sensitivity but having a greater sensitivity with respect to light, the second layer including a silver halide having a silver iodide content in the range of 9% by mol to 15% by mol. The material includes a DIR compound in a layer other than the second silver halide emulsion layer. The DIR compound releases a diffusible development inhibitor or precursor thereof by a coupling reaction. The resulting material has greatly improved granularity and sharpness.

10 Claims, 3 Drawing Figures

SILVER HALIDE COLOR PHOTOGRAPHIC LIGHT-SENSITIVE MATERIALS

FIELD OF THE INVENTION

The present invention relates to silver halide color photographic light-sensitive materials and, particularly, to photographing color light-sensitive materials in which graininess, sharpness and color reproduction are improved at the same time.

BACKGROUND OF THE INVENTION

In recent years, steps have been taken to minimize the size of films in order to improve the portable use of cameras by miniaturization thereof. However, minimization of the films brings about deterioration of quality of prints, which is well known. Namely, production of prints having the same size requires a larger magnification of enlargement, and, consequently, graininess and sharpness of the printed images become inferior. Accordingly, it is necessary to improve graininess, resolving power and sharpness of films in order to obtain good prints using miniaturized cameras. It is, of course, desired to use films which give clear color.

Improvement of the graininess or granularity can be carried out by increasing the number of silver halide particles as described in T. H. James, *The Theory of the Photographic Process,* 4th Ed., pp. 620 and 621, and by diffusing dyes formed by color development. However, in order to increase the number of silver halide particles while maintaining the photographic sensitivity, the amount of silver coated increases resulting in deterioration of resolving power, and it is disadvantageous with respect to cost and photographic properties.

Further, with attempts of improving granularity by diffusion of dyes, when non-diffusible couplers which form a dye of such mobility that controlled image smearing occurs are used as described in, for example, British Pat. No. 2,083,640 A, the so-called RMS granularity (RMS granularity has been described in T. H. James, *The Theory of the Photographic Process,* 4th Ed., p. 619) is remarkably improved. However, since arrangement of silver halide particles and development probability are brought in random processes, the dye diffuses and mixes with adjacent dyes depending upon the degree of diffusibility, whereby overlap of dye clouds becomes large and, consequently, huge dye clouds are randomly formed. It is very visually unpleasant and the granularity sometimes seems to be rather deteriorated. Further, as naturally expected, sharpness deteriorates because of dye diffusion.

On the other hand, in order to improve the sharpness, it has been known to use compounds which form a dye and release a development inhibitor by coupling with an oxidation product of the color developing agent, as described in U.S. Pat. Nos. 3,148,062 and 3,227,554, and compounds which release a development inhibitor by coupling with an oxidation product of the color developing agent but do not form a dye, as described in U.S. Pat. No. 3,632,345 (hereinafter, both compounds are referred to as "DIR compounds"). However, if the amount of DIR compounds added is increased, the coloring property deteriorates, and, consequently, the coating amount of silver halide or couplers increases in order to compensate for the above fault resulting in deterioration of the resolving power in a high space frequency area. Accordingly, there is a limit in improvement of sharpness by this process.

Further, if the coating amount of silver is reduced, light scattering of the emulsion layer becomes small and improvement of sharpness can be attained. However, it is obvious that, when the coating amount of silver is reduced, the number of development active points is reduced causing deterioration of granularity.

As described above, improvement of granularity and sharpness has been attempted in this field of the art as a subject for study, but sufficient results have not been obtained yet. In many cases, the means of improvement have an inverse relationship to one another, as described above.

SUMMARY OF THE INVENTION

An object of the present invention is to provide silver halide color light-sensitive materials having greatly improved granularity and sharpness.

Another object of the present invention is to provide silver halide color negative films having high sensitivity and excellent granularity, sharpness and color reproduction.

As a result of studies relating to various kinds of silver halide emulsion, various kinds of raw materials and various layer constructions including the above-described constructions, the present inventors have found that light-sensitive materials having high sensitivity and excellent granularity, sharpness and color reproduction are obtained by suitably combining silver halide emulsion layers wherein each of the layers has a different silver iodide content and, further, using certain kinds of DIR compounds.

Namely, the present invention relates to silver halide color photographic light-sensitive materials comprising at least two or more emulsion layers having the same color sensitive property, the sensitivity of which is different, which are characterized in that the layer having the maximum sensitivity of the above-described emulsion layers contains silver halide having a silver iodide content of 9% by mol to 15% by mol and at least one layer except the layer having the maximum sensitivity contains a DIR compound which releases a diffusible development inhibitor or a diffusible development inhibitor precursor by a coupling reaction. In the following it is illustrated in detail.

DETAILED DESCRIPTION OF THE INVENTION

Figure 1:
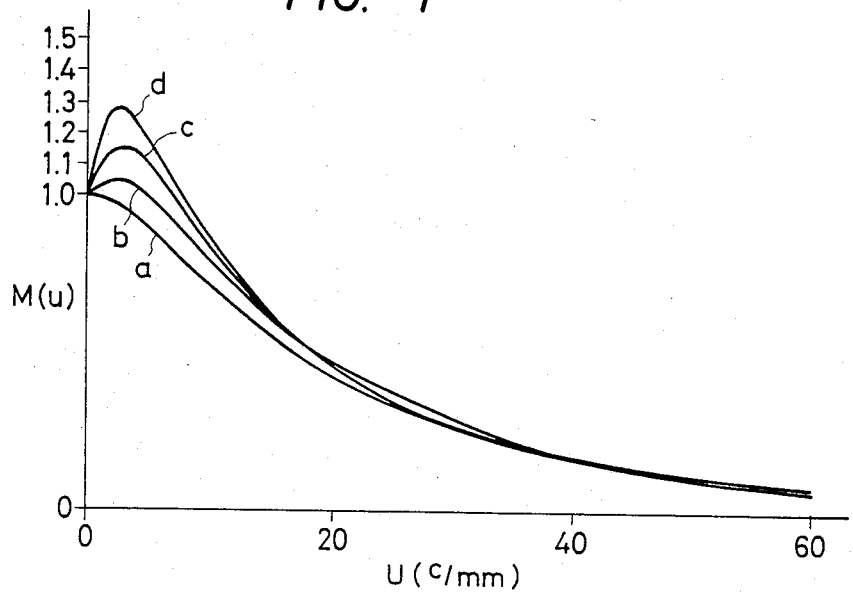
FIG. 1 is a graph showing MTF curves when varying the degree of diffusion of the released development inhibitor from 0.1 to 0.8 while maintaining the same degree of inhibition, wherein "a" is a degree of diffusion 0.1, "b" is a degree of diffusion 0.2, "c" is a degree of diffusion 0.4, and "d" is a degree of diffusion 0.8.

On the market, high speed photographic light-sensitive materials, particularly, those of ISO-400 class, are frequently used with only a small amount of exposure. The granularity of the negative formed with such materials, in low density areas, contributes greatly to collective evaluation of the quality of images. The layer which controls the granularity in the low density area is a high speed layer present in each of the color-sensitive layers. Accordingly, it is very important to design a high speed layer having good granularity which is particularly used in connection with high speed photographic light-sensitive materials.

A generally known technique of improving granularity involves increasing the iodine content of silver halide emulsions. However, emulsions containing a large amount of iodine (hereinafter referred to as "high iodine emulsion") release a large amount of iodine ion when the development proceeds to some degree. These ions control the subsequent development (refer to T. H. James, *The Theory of the Photographic Process,* 4th Ed., p. 418) thus providing a soft photographic characteristic curve. Further, granulation hardly disappears, and the granularity in high density areas is sometimes rather deteriorated.

If the ratio of silver halide to the coupler is increased as described in, for example, British Pat. No. 923,045, softening caused by using the high iodine emulsion can be prevented, and light-sensitive materials having excellent granularity are obtained due to the effective disappearance of granulation.

However, it is very difficult to adopt such a process for a low speed layer having a wide latitude, because it is necessary to greatly increase the amount of silver in the coating, by which sharpness of the lower layer is remarkably damaged. Further, even when using the above-described process for the high speed layer having a comparatively narrow latitude, sharpness also deteriorates because the amount of silver in the high speed layer is increased, the excess oxidation product of the developing agent formed in the high speed layer diffuses, and development effect in the adjacent low speed layer or other color-sensitive layers is not likely to influence the high speed layer, because development in the granulation disappearance part proceeds too fast.

A process using a DIR compound in the high speed layer has been proposed in order to compensate for the deterioration of sharpness. However, disappearance of granulation is not effective, because development is controlled by the DIR compound in the early stage of development, and, further, the sensitivity is deteriorated. Accordingly, when it is difficult to develop silver halide emulsions which compensate for the reduction of sensitivity caused by addition of the DIR compound, for example, in case of high speed photographic light-sensitive materials of ISO-400 class, it is very difficult to incorporate DIR compounds in the high speed layer for the purpose of improving sharpness.

As described above, if the amount of DIR compounds is increased or DIR compounds having a high degree of inhibition are used in order to obtain sufficient sharpness, the degree of inhibition of not only the layer to which DIR compounds are added but also the layer in which the DIR compounds diffuse increases. Accordingly, the sensitivity and the coloring property of these layers are generally deteriorated. If the coating amount of silver halide or couplers is increased in order to compensate for the above described fault, the resolving power in the high space frequency area is deteriorated naturally.

In order to improve sharpness without having such side effects, it is preferred to increase the MTF value in the low space frequency area (value at a certain point of space frequency on the MTF curve). The MTF curve is referred to C. E. K. Mess: *The Theory of the Photographic Process,* 3rd Ed., pp. 536 to 539), i.e., the so-called edge effect, with preventing reduction of sensitivity as far as possible, namely, without increasing the degree of inhibition as far as possible. This purpose is attained by using DIR couplers of DIR compounds having a large degree of diffusion of the development inhibitor released by a coupling reaction (hereinafter referred to as "diffusible DIR compound").

In the following, changes of the MTF curve when using the diffusible DIR coupler are theoretically explained.

The MTF curve is put under the control of light scattering in the high space frequency area and is put under the control of the so-called edge effect due to control of development in the low space frequency area. In the former case, it changes due to the thickness of the substance which scatters light, for example, silver halide. The MTF value in the high space frequency becomes lower as the thickness increases, due to increased light scattering. On the other hand, in the latter case, when diffusion of the development inhibitor is great, the edge effect reaches more remote areas and, consequently, the MTF value becmes high in even the low space frequency.

Figure 2:
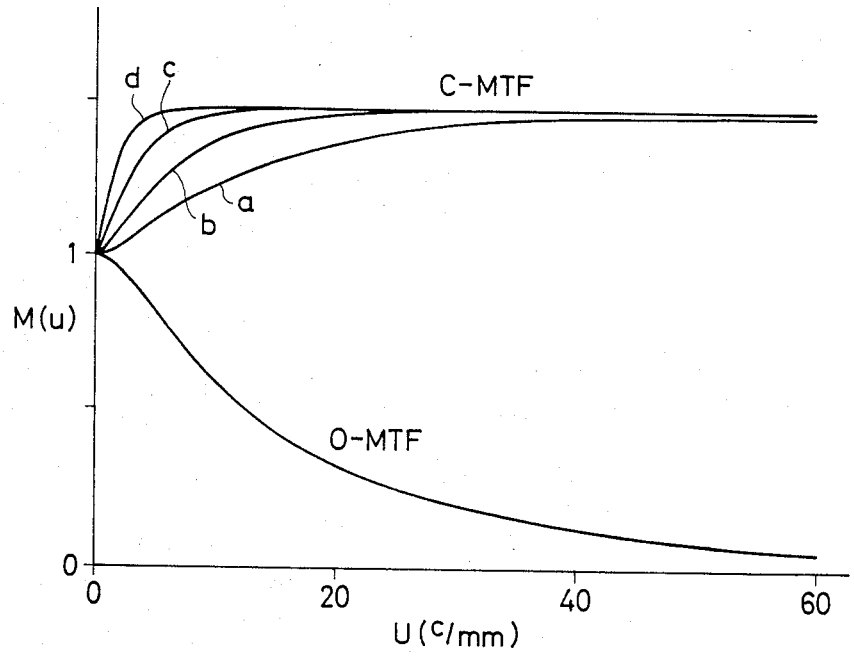
FIG. 2 shows a graph with C-MTF curves thereon when varying the degree of diffusion and also shows an O-MTF curve, within FIGS. 1 and 2M (u) represents an MTF value and u represents a space frequency.

The C-MTF shown in FIG. 2 represents MTF curves having a degree of diffusion of the development inhibitor which is increased from a to d while maintaining the degree of inhibition at the same value. The larger the degree of diffusion is, the higher the MTF value is in the low space frequency area. On the other hand, O-MTF is an MTF curve with constant light scattering which does not have the edge effect. Actual MTF values are values obtained by multiplying an MTF value at each point on the C-MTF curve: Mc(u) by a corresponding MTF value Mo(u) on the O-MTF curve. Accordingly, MTF curves representing only a varying degree of diffusion of the development inhibitor while maintaining the same degree of inhibition are shown in FIG. 1.

As described above, the edge effect can be increased by increasing the degree of diffusion of the development inhibitor to be released, even though the degree of inhibition thereof is the same.

When the diffusible DIR compounds having the above-described characteristics which have the same degree of inhibition as that of the prior DIR compounds are used instead of the prior DIR compounds, the edge effect is increased and the sharpness is improved. Further, when the diffusible DIR compounds are added to another layer, it is expected that the inhibition effect for the desired layer is attained, because the degree of diffusion of the development inhibitor is large. For example, when the diffusible DIR compounds are added to a low speed layer, it can be expected to increase the edge effect of the high speed layer or to improve the granularity thereof. In order to ascertain this fact, the following experiment (Example 1) was carried out. Further, the use of a high iodine emulsion in the high speed layer was examined.

EXAMPLE 1

Color light-sensitive materials having the following emulsion composition were prepared on a transparent base to produce Samples A to D.

Sample A

Low Speed Layer

To silver iodobromide (silver iodide content: 5.5% by mol, average particle size: 0.6μ) prepared by a double jet process, Coupler Y-1 was added in an amount of 0.095 mol per mol of silver and Coupler D-3 was added in an amount of 3% by mol based on Coupler Y-1, and it was applied so as to result in a coating amount of silver of 0.95 g/m².

Sample D

In Sample A, the emulsion in the high speed layer was replaced with a high iodine silver iodobromide emulsion (silver iodide content: 10.5% by mol, average particle size: 1.2μ) prepared by the same process and the coating amount of silver in the high speed layer was increased in an amount of 5% in order to adjust gradation to that of Sample A (molar ratio of silver/coupler was constant).

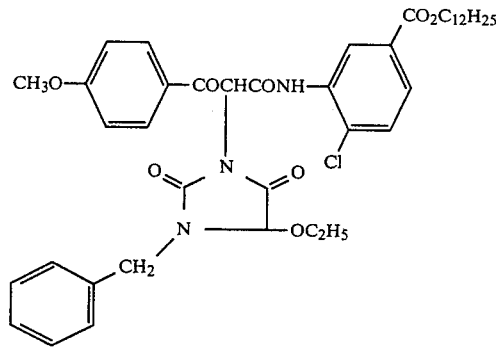

Coupler Y-1

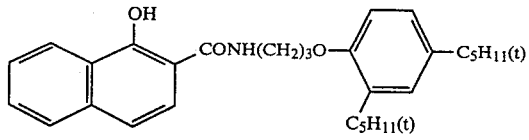

Coupler C-1

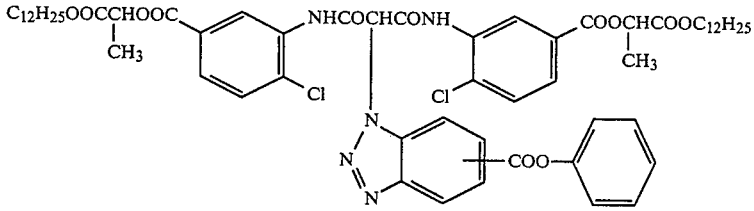

Coupler D-3

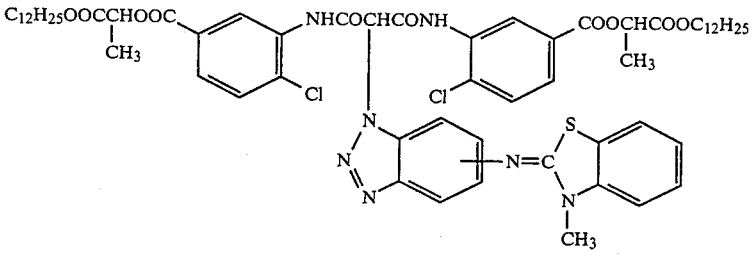

Coupler E-1

High Speed Layer

To silver iodobromide (silver iodide content: 7.0% by mol, average particle size: 1.2μ) prepared by a double jet process, Coupler C-1 was added in an amount of 0.01 mol per mol of silver, and it was applied so as to result in a coating amount of silver of 2.0 g/m².

Sample B

In Sample A, Coupler D-3 in the low speed layer was replaced with an equimolar amount of Coupler E-1.

Sample C

In Sample A, Coupler D-3 in the low speed layer was removed and the coating amount of silver in the low speed layer was reduced in an amount of 10% (molar ratio of silver/coupler was constant) in order to adjust gradation.

Here, the cyan coupler is used in the high speed layer and the yellow coupler is used in the low speed layer because the effect of development inhibition of the low speed layer influencing the high speed layer is separated making it easy to see. In each sample, gelatin hardeners and surface active agents may be contained in addition to the above-described composition.

Figure 3:
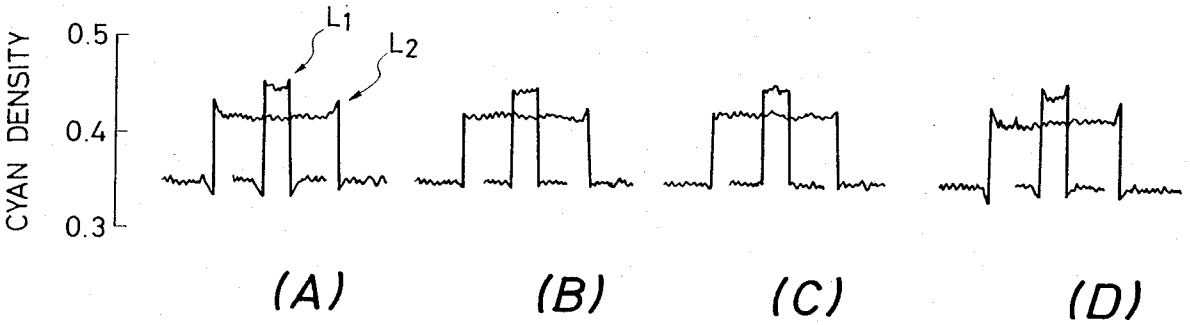
FIG. 3 shows the edge effect of Samples (A), (B), (C) and (D), wherein $L_1$ is a graph of slit width of 10 $\mu$m and $L_2$ is a graph of slit width 500 $\mu$m, further wherein the abscissa of the data of slit width 10 $\mu$m is enlarged 10 times as compared with that of 500 $\mu$m.

After the resulting Samples A to D were exposed to white light through a continuous wedge, they were processed according to the same procedure as in Example 4, except that the development was carried out for 2 minutes and 45 seconds. The resulting cyan density was measured to determine the exposure which provided a density of fog density +0.15. Then, Samples A to D were uniformly exposed again at an exposure 10 times the above-described exposure and they were further exposed to light through a slit of 10μ width or 500μ width using soft X-rays. After the development, the edge effect of cyan color images was measured by means of a microdensitometer (determination of edge effect is referred to T. H. James, *The Theory of the Photographic Process,* 4th Ed., pp. 609 to 611). Results are shown in FIG. 3. The results clearly show that Samples A and D to which the diffusible DIR Compound D-3 was added cause a high edge effect. Accordingly, it can be understood that the edge effect of the high speed layer can be improved as expected, even if the DIR compound is used in the low speed layer.

In accordance with the above-described results it is clear that the sharpness of the high speed layer can be improved by addition of the diffusible DIR compounds to the low speed layer. However, it is necessary to examine the effect on granularity.

Samples A to D were processed by the same procedure as in Example 4, except that the exposure to light was carried out using a stepwedge and the development was carried out for 2 minutes and 45 seconds. Granularity of cyan color images was judged by the conventional RMS (Root Mean Square) method. Judgment of the granularity by the RMS method is well known by persons skilled in the art, which has been described in *Photographic Science and Engineering,* Vol. 19, No. 4 (1975), pp. 235 to 238 under the subject "RMS Granularity; Determination of Just Noticeable Difference". The aperture for measurement used is 48μ. In Table 1, RMS values of Samples A to D in densities of 0.10 and 0.3 are collected.

The RMS values in Table 1 clearly show that the granularity of cyan color images in the high speed layer is improved by adding the diffusible DIR compound to the low speed layer. In samples to which the diffusible DIR Coupler D-3 was added (Samples A and D), granularity in both low density parts and high density parts is improved as compared with the sample to which DIR compounds were not added (Sample C), and the degree of improvement in the low density parts is particularly high. Such an effect is hardly observed in the sample to which the prior DIR Coupler E-1 was added (Sample B).

TABLE 1

| | RMS Values of Cyan Color Images | | | |
|---|---|---|---|---|
| | A (Present Invention) | B (Comparative Example) | C (Comparative Example) | D (Present Invention) |
| Density 0.1 | 0.016 | 0.022 | 0.023 | 0.012 |
| Density 0.3 | 0.013 | 0.018 | 0.018 | 0.014 |

Fog density in each sample is 0.06.

The granularity is improved particularly in low density parts of the high speed layer, when the diffusible DIR compound is used in the low speed layer. The improvement is believed to occur because DIR releasing radicals discharged by a coupling reaction, which cause coloring of fog parts or neighboring parts in the low sensitive layer, diffuse into the high speed layer. This diminishes dye clouds in the low density area of the high speed layer including coloring by fog. It is naturally expected that the granularity in the high density area of the high speed layer itself deteriorates according to deterioration of the effect of granulation disappearance of the high speed layer caused by development inhibition by the low speed layer, but the deterioration is not observed in reality. This is believed to be due to the fact that, though the granulation disappearance is deteriorated by the DIR releasing radicals discharged from the low speed layer, it is compensated for by improvement of granularity in the above-described fog parts. Alternatively, it is believed that, since the inhibitor diffuses after the development proceeds to some degree, which is different from the case of adding the DIR compound to the high speed layer, undeveloped silver halide particles are small in number and the granulation disppearance is not deteriorated so much.

It becomes obvious as described above that granularity of the high speed layer is improved by using the diffusible DIR compound in the low speed layer. Further, when a high iodine emulsion having a silver iodide content of 10.5% by mol is used in the high speed layer, granularity of the low density parts is more improved as shown in Table 1. Although the granularity in the high density parts has a tendency toward slight deterioration, it is not inferior to Samples B and C. When using high iodine emulsions having good granularity, it has been believed that the use of the DIR compounds for the purpose of improving sharpness is difficult because it causes reduction of sensitivity or deterioration of granulation disappearance. However, when the low speed layer to which the diffusible DIR compound is added is combined with the high speed layer using a high iodine emulsion, it is possible to obtain photographic characteristics having high sensitivity and excellent granularity and sharpness, which could not be obtained by the prior art (refer to FIG. 3 and Table 1).

In view of the improved granularity of the high speed layer due to the use of the diffusible DIR compound in the low speed layer, studies were conducted on the effect of development inhibition by diffusible DIR releasing radicals discharged by coloring of the fog parts in the low speed layer. If the granularity is improved by such a reason, it can be expected to further improve granularity in the low density area of the high speed layer by using an emulsion having high development activity, namely, an emulsion easily fogged, in the low speed layer.

Generally, silver halide emulsions having a low silver iodide content (hereinafter referred to as "low iodine emulsion") have a high development activity, because discharge of iodine ions which bring about development inhibition is slight (refer to T. H. James, *The Theory of the Photographic Process,* 4th Ed., p. 418). Thus, whether the granularity of the high speed layer can be further improved as described above or not when the low iodine emulsion is used in the low speed layer has been examined using Samples D, E and F (Example 2).

EXAMPLE 2

Sample E

In Sample D, the emulsion in the low speed layer was replaced with a low iodine silver iodobromide emulsion (silver iodide content: 3.0% by mol, average particle size: 0.6μ) prepared by the same manner as that of the above emulsion.

Sample F

In Sample E, the amount of Coupler D-3 was increased to 6% by mol of Coupler Y-1 in order to adjust gradation of the low speed layer (gradation becomes hard when the emulsion in the low speed layer was replaced with the low iodine emulsion).

RMS values of cyan color images (high speed layer parts) and yellow color images (low speed layer parts) in Samples D, E and F were measured by the same method as that of obtaining results shown in Table 1. Results are collected in Table 2.

As expected, in Sample E using the low iodine emulsion having a high development activity, granularity of cyan color images, particularly, in the low density parts of the high speed layer is improved as compared with Sample D. Accordingly, it has been proved that discharge of the diffusible DIR releasing radicals by fog coloring of the low speed layer contributes to improvement of granularity. The present inventors have now found that the granularity of adjacent layers can be improved by combining the diffusible DIR compound utilizing fog coloring. Further, when the low iodine emulsion is used, the effect of improving granularity becomes greater, because the amount of the DIR compound can be increased. Furthermore, sharpness of the layer to which the diffusible DIR compound is added and adjacent layers is naturally further improved.

It is understood from Table 2 that, with respect to granularity of the low speed layer in yellow color images, the RMS value is deteriorated when the emulsion in the low speed layer was replaced with the low iodine emulsion. However, the RMS value is improved when the amount of the DIA compound is increased in order to reduce the gamma value of the emulsion so as to adjust gradation, and it reaches to a better level than when not using the low iodine emulsion.

TABLE 2

RMS Values of Cyan Color Images and Yellow Color Images

| | Density | Sample D | Sample E | Sample F |
|---|---|---|---|---|
| Cyan Color Image | 0.1 | 0.012 | 0.009 | 0.007 |
| " | 0.3 | 0.014 | 0.013 | 0.012 |
| Yellow Color Image | 0.3 | 0.015 | 0.018 | 0.012 |

Fog density of cyan color image in each sample is 0.06.
Fog density of yellow color image is 0.05 in D, 0.07 in E, and 0.05 in F.

The above-described experiments and studies were carried out according to the present invention. Based on these experiments it was determined that when a high iodine emulsion having good granularity was used in the high speed emulsion and a low iodine emulsion having a high development activity was used in the low speed layer and a diffusible DIR compound was incorporated therein, photographic characteristics having high sensitivity and excellent granularity and sharpness, which are difficult to obtain with prior art materials, can be obtained.

The present invention is embodied by providing silver halide color photographic light-sensitive materials comprising at least two or more emulsion layers. These layers have the same color sensitive property, the sensitivity of which is different. The layer having the maximum sensitivity of the above-described emulsion layers contains silver halide having a silver iodide content of 9% by mol to 15% by mol. At least one layer, other than the layer having the maximum sensitivity, contains a DIR compound which releases a diffusible development inhibitor or a diffusible development inhibitor precursor by a coupling reaction.

In the above-described emulsion layers, the effect of the present invention is shown in any of the blue-sensitive layer, green-sensitive layer and red-sensitive layer.

In the present invention, a particularly preferred case with respect to the effect is that wherein the emulsion in the emulsion layer containing the diffusiable DIR compound is composed of silver halide having a silver iodide content of 5% by mol or less. The object of the present invention is attained by using a high iodine emulsion in the high speed layer and using a low iodine emulsion in the low speed layer having the same color sensitive property and by incorporating a diffusible DIR compound in the low speed layer, or by incorporating a diffusible DIR compound in another color-sensitive layer in case of obtaining an interimage effect on said color sensitive layer by another color-sensitive layer.

Here, the low speed layer may be composed of a plurality of layers having the same color sensitive property, wherein a low iodine emulsion is used in at least one layer. As a result of various experiments, the present inventors found that it is necessary to use silver halide having an iodine content of 5% by mol or less, preferably 2 to 4% by mol, as the low iodine emulsion, and silver halide having an iodine content of 9% by mol to 15% by mol, preferably 10 to 14% by mol, as the high iodine emulsion in the high speed layer, in order to attain the objects of the present invention.

In the low iodine emulsions (silver iodide: 5% by mol or less) used in the present invention may be used any of silver bromide, silver iodobromide, silver iodochlorobromide, silver chlorobromide and silver chloride.

Further, in the high iodine emulsions (silver iodide: 9% by mol to 15% by mol), any of silver iodobromide and silver iodochlorobromide may be used. Silver iodobromide is particularly preferred in both low iodine emulsions and high iodine emulsions.

The average particle size of these silver halide particles (the particle size means the diameter of particles in case of spherical or nearly spherical particles or the side length in case of cubic particles, which is represented as an average based on projection areas) is not particularly restricted, but it is preferred to be 3$\mu$ or less.

The distribution of particle size may be broad or narrow.

These silver halide particles may have a regular crystal form such as cube, octahedron or the like. Further, they may have an irregular crystal form such as sphere or plate, etc., or may have a complex crystal form. They may be composed of a mixture of particles having various crystal forms.

The silver halide particles may have a structure wherein the inner part and the surface layer are composed of different phases, or they may be composed of a homogeneous phase. Further, they may be particles wherein latent images are formed mainly on the surface or may be particles wherein the latent images are formed mainly in the inner part.

Photographic emulsions used in the present invention can be prepared by processes described in P. Glafkides, *Chemie et Physique Photographique* (published by Paul Montel Co., 1967), G. F. Duffin, *Photographic Emulsion Chemistry* (published by The Focal Press, 1966) and V. L. Zelikman et al., *Making and Coating Photographic Emulsion* (published by The Focal Press, 1964), etc. Namely, they may be prepared by any of acid process, neutral process and ammonia process, etc. Further, as a type of reacting soluble silver salts with soluble halogen salts, a single jet mixing process, a double jet mixing process or a combination of them may be used.

A process for forming particles in the presence of excess silver ions (the so-called back mixing process)

can also be used. As one type of the double jet mixing process, it is possible to use a process wherein the pAg in the liquid phase of forming silver halide is kept at a constant value, namely, the so-called controlled double jet process.

According to this process, silver halide emulsions having a regular crystal form and a nearly uniform particle size are obtained.

Two or more silver halide emulsions prepared respectively may be used for the high speed layer and the low speed layer by blending so as to have the above-described iodine content.

In the process of forming silver halide particles or physical aging, cadmium salts, zinc salts, lead salts, thallium salts, iridium salts or complex salts thereof, rhodium salts or complex salts thereof, and iron salts or complex salts thereof, etc., may be added.

As emulsions those having any distribution of particle size may be used. However, in color negative low speed emulsion layers which require long exposure latitude, emulsions having a wide distribution of particle size (which are called polydisperse emulsions) may be used or monodisperse emulsions having a narrow distribution of particle size (the monodisperse emulsions mean those wherein 90% or more based on the weight or the number of all particles are included in a range within ±40% of the average particle size) may be used as a mixture of two or more of them. Monodisperse emulsions and polydisperse emulsions may be used as a mixture. However, it is necessary to satisfy the condition that at least one layer in the low speed layer composed of one or more layers have an iodine content of 5% by mol or less. Further, in the high speed emulsion layer, it is preferred to use the monodisperse emulsions in order to avoid softening. The monodisperse emulsions may be those wherein the inner part and the surface layer have a uniform composition and the same properties, or they may have the so-called core-shell structure, wherein the inner part and the surface area have different compositions and different properties.

In order to remove soluble salts from emulsions after formation by precipitation or after physical aging, a noodle water wash method wherein gelatin is gelled may be used. Further, a precipitation method (flocculation) utilizing inorganic salts, anionic surfactants, anionic polymers (for example, polystyrene sulfonic acid) or gelatin derivatives (for example, acylated gelatin or carbamoylated gelatin, etc.) may be used.

Silver halide emulsions are generally chemically sensitized. In order to carry out chemical sensitization, it is possible to use processes described in, for example, *Die Grundlagen der Photographischen Prozesse mit Silberhalogeniden,* edited by H. Frieser (Akademische Verlagsgesellschaft, 1968), pp. 675 to 734.

Namely, it is possible to use a sulfur sensitization process using silver containing compounds capable of reacting with active gelatin or silver (for example, thiosulfates, thioureas, mercapto compounds, or rhodanines), a reduction sensitization process using reducing substances (for example, stannous salts, amines, hydrazine derivatives, formamidine sulfinic acid, silane compounds) and a noble metal sensitization process using noble metal compounds (for example, gold complex salts and complex salts of metals of Group VIII in the Periodic Table, such as Pt, Ir or Pd, etc.), which can be used alone or as a combination thereof.

Examples of the sulfur sensitization process have been described in U.S. Pat. Nos. 1,574,944, 2,410,689, 2,278,947, 2,728,668 and 3,656,955, etc., those of the reduction sensitization process have been described in U.S. Pat. Nos. 2,983,609, 2,419,974 and 4,054,458, etc., and those of the noble metal sensitization process have been described in U.S. Pat. Nos. 2,399,083 and 2,448,060 and British Pat. No. 618,061, etc.

The diffusible DIR compound is sufficient if added to at least one unit layer of at least one color-sensitive layer selected from blue-sensitive layer, green-sensitive layer and red-sensitive layer, but it is preferably added to a low iodine emulsion layer. Further, in case of obtaining an interimage effect on the color-sensitive layer containing a low iodine emulsion by another color-sensitive layer, it is preferable to add the diffusible DIR compound to another layer.

The amount of the diffusible DIR compound is in a range of 0.0001 to 0.1 mol, preferably 0.001 to 0.05 mol, per mol of silver halide. Known DIR compounds which release a development inhibitor having a comparatively small diffusibility or a precursor thereof may be used together in the same layer or a different layer.

The compound which releases a diffusible development inhibitor or a diffusible development inhibitor precursor by coupling with a color developing agent, used in the present invention (diffusible DIR compound) means that which has a development inhibitor having a degree of diffusion of 0.4 or more measured by the following method as a releasing group.

The degree of diffusion of the development inhibitor in the present invention can be measured by the following method.

A multilayer color light-sensitive material having the following composition was formed on a transparent base to produce Sample H.

The First Layer: Red-Sensitive Silver Halide Emulsion Layer

A layer which was produced by applying a gelatin coating solution containing a red-sensitive emulsion prepared by adding $6\times10^{-5}$ mol of Sensitizing Dye I in Example 4 per mol of silver to a silver iodobromide emulsion (silver iodide: 5% by mol, average particle size: 0.4μ) and 0.0015 mol of Coupler C-2 per mol of silver so as to have a coating amount of silver of 1.8 g/m$^2$ (thickness of the film: 2μ).

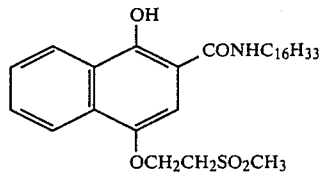

Coupler C-2

The Second Layer:

A gelatin layer containing a silver iodobromide emulsion used in the first layer (which did not have red sensitivity) and polymethyl methacrylate particles (diameter: about 1.5μ) (coating amount of silver: 2 g/m$^2$, thickness of the film: 1.5μ)

In each layer, gelatin hardeners and surface active agents were contained in addition to the above-described composition.

As Sample G, a light-sensitive material having the same construction as that of Sample H, except that the silver iodobromide emulsion was not contained in the second layer, was produced.

After the resulting Samples G and H were exposed to light wedge, they were processed according to the same procedure as in Example 4 except that the development was carried out for 2 minutes and 10 seconds. A development inhibitor was added to the developing solution till the density of Sample G was reduced to ½. Using the degree of density reduction of Sample H in this case, diffusibility in the silver halide emulsion layer was determined. Results are shown in Table 3.

TABLE 3

Degree of Diffusion of Development Inhibitors

| Development Inhibitor | Amount Added to Developing Solution (M) | Density Reduction Rate: Sample D (%) | Density Reduction Rate: Sample E (%) | Degree of Diffusion (E/D) |
|---|---|---|---|---|
| 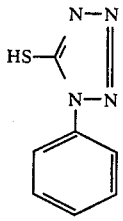 | $0.75 \times 10^{-4}$ | 50 | 10 | 0.2 |
| 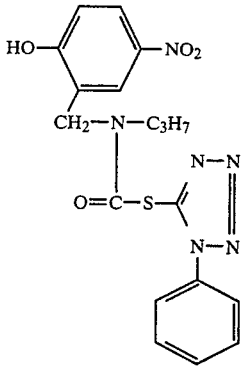 | $1 \times 10^{-4}$ | 50 | 25 | 0.5 |
| 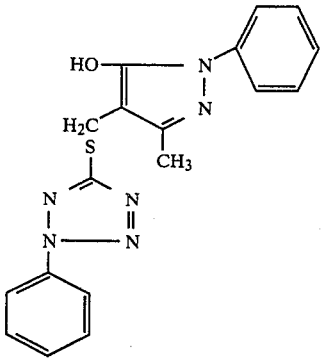 | $0.8 \times 10^{-4}$ | 48 | 20 | 0.42 |
| 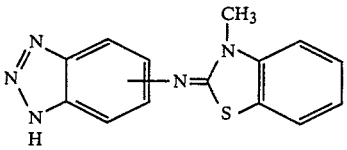 | $0.5 \times 10^{-4}$ | 50 | 15 | 0.3 |
| 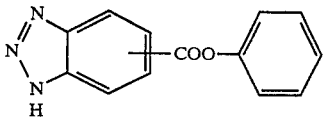 | $2 \times 10^{-4}$ | 52 | 37 | 0.74 |

TABLE 3-continued

| Degree of Diffusion of Development Inhibitors | | | | |
|---|---|---|---|---|
| | Amount Added to Developing Solution | Density Reduction Rate | | |
| Development Inhibitor | (M) | Sample D (%) | Sample E (%) | Degree of Diffusion (E/D) |
| 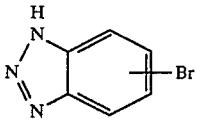 | $2.5 \times 10^{-4}$ | 51 | 45 | 0.9 |

EXAMPLE 3

Samples I and J were prepared by the same manner as in Sample A, except that Couplers D-16 and D-15 were used instead of Coupler D-3 in Sample A. Using Samples A, B, C, I and J, RMS values were measured by the same manner as in Example 1. Results are collected in Table 4.

TABLE 4

| Degree of Diffusion of DIR Compound and RMS Value | | | | | |
|---|---|---|---|---|---|
| | Sample | | | | |
| | C | B | I | J | A |
| Degree of Diffusion | — | 0.3 | 0.42 | 0.5 | 0.74 |
| Density 0.1 | 0.023 | 0.022 | 0.018 | 0.017 | 0.013 |
| Density 0.3 | 0.018 | 0.018 | 0.015 | 0.013 | 0.010 |

It is understood from the above-described results that RMS granularity is improved when a coupler containing a development inhibitor compound having a degree of 0.4 or more as a releasing group is used.

The diffusible DIR compound used in the present invention is selected from compounds represented by the following general formula (I).

$$A\text{-}(Y)_m \quad (I)$$

(1) In the formula, A represents a coupler component, m represents 1 or 2, and Y represents a group which is attached to a coupling position of the coupler component A and is released by a reaction with an oxidation product of the color developing agent, which is a development inhibitor having a large diffusibility or a compound capable of releasing the development inhibitor, the degree of diffusion of which is 0.4 or more measured by the above-described method.

(2) In the general formula (I), Y represents the following general formula (II) to (V).

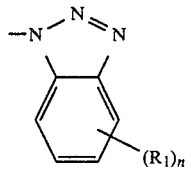

(II)

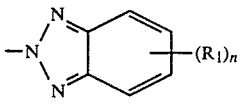

(III)

-continued

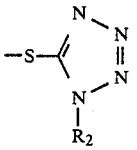

(IV)

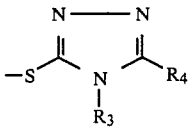

(V)

In the general formulae (II) and (III), $R_1$ represents an alkyl group, an alkoxy group, an acylamino group, a halogen atom, an alkoxycarbonyl group, a thiazolylideneamino group, an aryloxycarbonyl group, an acyloxy group, a carbamoyl group, an N-alkylcarbamoyl group, an N,N-dialkylcarbamoyl group, a nitro group, an amino group, an N-arylcarbamoyloxy group, a sulfamoyl group, an N-alkylcarbamoyloxy group, a hydroxy group, an alkoxycarbonylamino group, an alkylthio group, an arylthio group, an aryl group, a heterocyclic group, a cyano group, an alkylsulfonyl group or an aryloxycarbonylamino group. In the general formulae (II) and (III), n represents 1 or 2, and $R_1$ may be identical or different when n is 2, wherein the number of carbon atoms in n of $R_1$ is a total of 0 to 10.

In the general formula (IV), $R_2$ represents an alkyl group, an aryl group or a heterocyclic group.

In the general formula (V), $R_3$ represents a hydrogen atom, an alkyl group, an aryl group or a heterocyclic group, and $R_4$ represents a hydrogen atom, an alkyl group, an aryl group, a halogen atom, an acylamino group, an alkoxycarbonylamino group, an aryloxycarbonylamino group, an alkanesulfonamido group, a cyano group, a heterocyclic group, an alkylthio group or an amino group.

When $R_1$, $R_2$, $R_3$ or $R_4$ represents an alkyl group, it may be substituted or unsubstituted and may be chain-like or cyclic. Examples of substituents include halogen atoms, nitro groups, cyano groups, aryl groups, alkoxy groups, aryloxy groups, alkoxycarbonyl groups, aryloxycarbonyl groups, sulfamoyl groups, carbamoyl groups, hydroxy groups, alkanesulfonyl groups, arylsulfonyl groups, alkylthio groups and arylthio groups, etc.

When $R_1$, $R_2$, $R_3$ or $R_4$ represents an aryl group, it may be substituted. Examples of substituents include alkyl groups, alkenyl groups, alkoxy groups, alkoxycarbonyl groups, halogen atoms, nitro groups, amino groups, sulfamoyl groups, hydroxy groups, carbamoyl groups, aryloxycarbonylamino groups, alkoxycarbonylamino groups, acylamino groups, cyano groups and ureido groups, etc.

When $R_1$, $R_2$, $R_3$ or $R_4$ represents a heterocyclic group, the heterocyclic group is a 5-membered or 6-membered monocyclic or condensed ring containing a nitrogen atom, an oxygen atom and a sulfur atom as hetero atoms, which is selected from a pyridyl group, a quinolyl group, a furyl group, a benzothiazolyl group, an oxazolyl group, an imidazolyl group, a thiazolyl group, a triazolyl group, a benzotriazolyl group, an imido group and an oxazine group, etc., which may be substituted by substituents described above concerning the aryl group.

In the general formula (IV), the number of carbon atoms contained in $R_2$ is 1 to 15.

In the general formula (V), the number of carbon atoms contained in $R_3$ and $R_4$ is a total of 1 to 15.

(3) In the general formula (I), Y represents the following general formula (VI).

-TIME-INHIBIT (VI)

In the formula, the group TIME represents a group attaching to a coupling position of the coupler and capable of cleaving by a reaction with the color developing agent, which is capable of releasing the group INHIBIT with such mobility that controlled image smearing occurs after being separated from the coupler. The group INHIBIT represents a development inhibitor.

(4) In the general formula (VI), the group -TIME-INHIBIT represents the following general formulae (VII) to (XIII).

(VII)

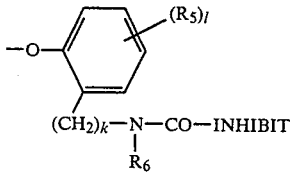

(VIII)

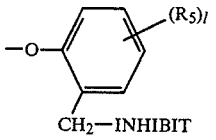

(IX)

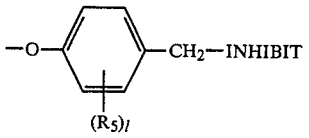

(X)

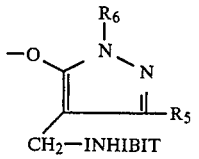

(XI)

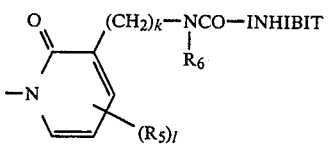

-continued (XII)

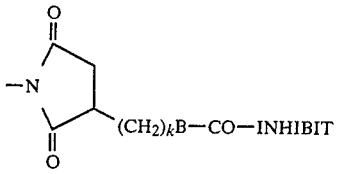

(XIII)

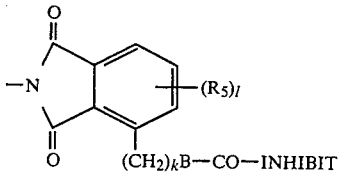

In the general formulae (VII) to (XIII), $R_5$ represents, a hydrogen atom, a halogen atom, an alkyl group, an alkenyl group, an aralkyl group, an alkxoy group, an alkoxycarbonyl group, an anilino group, an acylamino group, a ureido group, a cyano group, a nitro group, a sulfonamido group, a sulfamoyl group, a carbamoyl group, an aryl group, a carboxyl group, a sulfo group, a hydroxy group or an alkanesulfonyl group.

In the general formulae (VII), (VIII), (IX), (XI) and (XIII), l represents 1 or 2.

In the general formulae (VII), (XI), (XII) and (XIII), k represents an integer of 0 to 2.

In the general formulae (VII), (X) and (XI), $R_6$ represents an alkyl group, an alkenyl group, an aralkyl group, a cycloalkyl group or an aryl group.

In the general formulae (XII) and (XIII), B represents an oxygen atom or

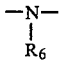

(wherein $R_6$ represents the same meaning as defined above).

The group INHIBIT represents the same meaning as that defined in the general formulae (II), (III), (IV) and (V), except the number of carbon atoms.

The number of carbon atoms contained in each $R_1$ in the molecule in the general formulae (II) and (III) is a total of 1 to 32, the number of carbon atoms contained in $R_2$ in the general formula (IV) is 1 to 32, and the number of carbon atoms contained in $R_3$ and $R_4$ in the general formula (V) is a total of 1 to 32.

When $R_5$ or $R_6$ represents an alkyl group, it may be substituted or not substituted and it may be chain-like or cyclic. As substituents, there are those described in case of $R_1$ to $R_4$ being an alkyl group.

When $R_5$ or $R_6$ represents an aryl group, it may be substituted. As substituents, there are those described in case of $R_1$ to $R_4$ being an aryl group.

Examples of yellow color image forming coupler residues represented by A include coupler residues of pivaloylacetanilide couplers, benzoylacetanilide couplers, malonic diester couplers, malonic acid diamide couplers, dibenzoylmethane couplers, benzothiazolylacetamide couplers, malonic ester monoamide couplers, benzothiazolylacetate couplers, benzoxazolylacetamide couplers, benzoxazolyl acetate couplers, benzimidazolylacetamide couplers or benzimidazolylacetate couplers, coupler residues derived from heterocycle substituted acetamide or heterocycle substituted acetate described in U.S. Pat. No. 3,841,880, coupler residues derived from acylacetamides described in U.S. Pat. No. 3,770,446, British Pat. No. 1,459,171, German Patent Application (OLS) No. 2,503,099, Japanese Patent Application (OPI) No. 139738/75 (the term "OPI" as used herein refers to a "published unexamined Japanese patent application") and *Research Disclosure,* No. 15737, and heterocyclic coupler residues described in U.S. Pat. No. 4,046,574.

Examples of magenta color image forming coupler residues represented by A include coupler residues having a 5-oxo-2-pyrazoline nucleus, a pyrazolo[1,5-a]-benzimidazole nucleus or a cyanoacetophenone coupler residue.

Examples of cyan color image forming coupler residues represented by A include coupler residues having a phenol nucleus or an α-naphthol nucleus.

Further, even if the coupler does not substantially form a dye after it releases a development inhibitor by coupling with an oxidation product of the developing agent, the effect of it as a DIR coupler is the same. Examples of coupler residues of this type represented by A include coupler residues described in U.S. Pat. Nos. 4,052,213, 4,088,491, 3,632,345, 3,958,993 and 3,961,959.

(5) In the general formula (I), A represents general formulae (IA), (IIA), (IIIA), (IVA), (VA), (VIA), (VIIA) and (VIIIA).

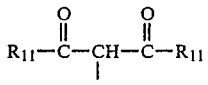
(IA)

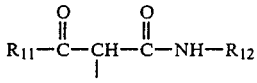
(IIA)

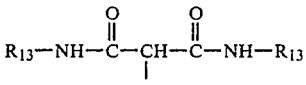
(IIIA)

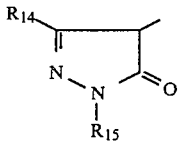
(IVA)

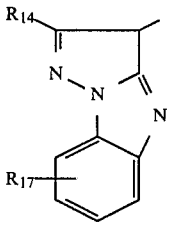
(VA)

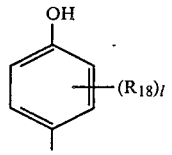
(VIA)

-continued

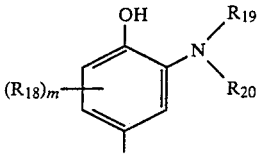
(VIIA)

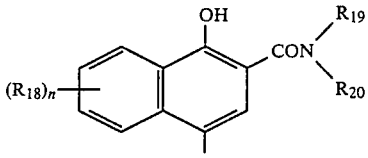
(VIIIA)

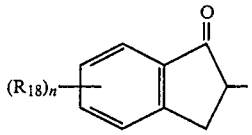
(IXA)

In the formulae, $R_{11}$ represents an aliphatic group, an aromatic group, an alkoxy group or a heterocyclic group, and $R_{12}$ and $R_{13}$ represent each an aromatic group or a heterocyclic group.

In the formulae, the aliphatic group represented by $R_{11}$ is preferred to have 1 to 22 carbon atoms, which may be substituted or unsubstituted and may be chain-like or cyclic. Preferred examples of substituents on the alkyl group include alkoxy groups, aryloxy groups, amino groups, acylamino groups and halogen atoms, which may have further substituents themselves. Preferred examples of the aliphatic group represented by $R_{11}$ include an isopropyl group, an isobutyl group, a tert-butyl group, an isoamyl group, a tert-amyl group, a 1,1-dimethylbutyl group, a 1,1-dimethylhexyl group, a 1,1-diethylhexyl group, a dodecyl group, a hexadecyl group, an octadecyl group, a cyclohexyl group, a 2-methoxyisopropyl group, a 2-phenoxyisopropyl group, a 2-p-tert-butylphenoxyisopropyl group, an α-aminoisopropyl group, an α-(diethylamino)isopropyl group, an α-(succinimido)isopropyl group, an α-(phthalimido)isopropyl group and an α-(benzenesulfonamido)isopropyl group, etc.

In case that $R_{11}$, $R_{12}$ or $R_{13}$ represents an aromatic group (particularly, phenyl group), the aromatic group may be substituted. The aromatic group such as a phenyl group, etc., may be substituted by alkyl groups having 32 or less carbon atoms, alkenyl groups, alkoxy groups, alkoxycarbonyl groups, alkoxycarbonylamino groups, aliphatic amido groups, alkylsulfamoyl groups, alkylsulfonamido groups, alkylureido groups, and alkyl substituted succinimido groups, etc., wherein the alkyl groups may have an aromatic group such as phenylene, etc., in the chain thereof. It may be substituted by phenyl groups, aryloxy groups, aryloxycarbonyl groups, arylcarbamoyl groups, arylamido groups, arylsulfamoyl groups, arylsulfonamido groups and arylureido groups, etc., wherein the aryl parts may be substituted further by one or more alkyl groups having a total of 1 to 22 carbon atoms.

The phenyl group represented by $R_{11}$, $R_{12}$ or $R_{13}$ may be further substituted by amino groups which may be substituted by lower alkyl groups having 1 to 6 carbon atoms, hydroxy group, carboxy group, sulfo group, nitro group, cyano group, thiocyano group and halogen atoms.

Further, $R_{11}$, $R_{12}$ or $R_{13}$ represents a substituent in which a phenyl group is fused with another ring, for example, a naphthyl group, a quinolyl group, an isoquinolyl group, a chromanyl group, a coumaranyl group or a tetrahydronaphthyl group. These substituents may have other substituents.

In case that $R_{11}$ represents an alkoxy group, the alkyl part of it represents a straight chain or branched chain alkyl group having 1 to 40 carbon atoms, preferably 1 to 22 carbon atoms, an alkenyl group, a cycloalkyl group or a cycloalkenyl group, which may be substituted by halogen atoms, aryl groups and alkoxy groups, etc.

In case that $R_{11}$, $R_{12}$ or $R_{13}$ represents a heterocyclic groups, the heterocyclic group is bonded to the carbon atom in the carbonyl part of the acyl group or the nitrogen atom of the amino group in the $\alpha$-acylacetamide through a carbon atom composing the ring. Examples of such heterocycles include thiophene, furan, pyrane, pyrrole, pyrazole, pyridine, pyrazine, pyrimidine, pyridazine, indolizine, imidazole, thiazole, oxazole, thiazine, thiadiazine and oxazine, etc. These rings may have substituents.

In the general formula (IVA), $R_{15}$ represents a straight chain or branched chain alkyl group having 1 to 40 carbon atoms, preferably 1 to 22 carbon atoms (for example, a methyl, isopropyl, tert-butyl, hexyl or dodecyl group, etc.), an alkenyl group (for example, an allyl group, etc.), a cycloalkyl group (for example, a cyclopentyl group, a cyclohexyl group or a norbornyl group, etc.), an aralkyl group (for example, a benzyl group or a $\beta$-phenylethyl group, etc.), or a cycloalkenyl group (for example, a cyclopentenyl group or a cyclohexenyl group, etc.), which may be substituted by halogen atoms, nitro group, cyano group, aryl groups, alkoxy groups, aryloxy groups, carboxy group, alkylthiocarbonyl groups, arylthiocarbonyl groups, alkoxycarbonyl groups, aryloxycarbonyl groups, sulfo group, sulfamoyl groups, carbamoyl groups, acylamino groups, diacylamino groups, ureido groups, urethane groups, thiourethane groups, sulfonamido groups, heterocyclic groups, arylsulfonyl groups, alkylsulfonyl groups, arylthio groups, alkylthio groups, alkylamino groups, anilino groups, N-arylanilino groups, N-alkylanilino groups, N-acylanilino groups, hydroxy group and mercapto group, etc.

Further, $R_{15}$ may represent an aryl group (for example, a phenyl group or an $\alpha$- or $\beta$-naphthyl group, etc.). The aryl group may have one or more substituents. Examples of the substituents include alkyl groups, alkenyl groups, cycloalkyl groups, aralkyl groups, cycloalkenyl groups, halogen atoms, nitro group, cyano group, aryl groups, alkoxy groups, aryloxy groups, carboxy group, alkoxycarbonyl groups, aryloxycarbonyl groups, sulfo group, sulfamoyl groups, carbamoyl groups, acylamino groups, diacylamino groups, ureido groups, urethane groups, sulfonamido groups, heterocyclic groups, arylsulfonyl groups, alkylsulfonyl groups, arylthio groups, alkylthio groups, alkylamino groups, dialkylamino groups, anilino groups, N-alkylanilino groups, N-arylanilino groups, N-acylanilino groups, hydroxy group and mercapto group, etc. Preferable examples of $R_{15}$ are phenyl groups in which at least one of o-positions is substituted by an alkyl group, an alkoxy group or a halogen atom, etc., which are useful because the coupler remaining in the film layer causes less coloring by light or heat.

Further $R_{15}$ may represent a heterocyclic group (for example, a 5-membered or 6-membered heterocyclic group containing nitrogen, oxygen or sulfur as hetero atoms, such as a pyridyl group, a quinolyl group, a furyl group, a benzothiazolyl group, an oxazolyl group, an imidazolyl group or a naphthoxazolyl group, etc.), heterocyclic groups substituted by substituents described above in the aryl group, an aliphatic or aromatic acyl group, an alkylsulfonyl group, an arylsulfonyl group, an alkylcarbamoyl group, an arylcarbamoyl group, an alkylthiocarbamoyl group or an arylthiocarbamoyl group.

In the formulae, $R_{14}$ represents a hydrogen atom, a straight chain or branched chain alkyl group having 1 to 40 carbon atoms, preferably 1 to 22 carbon atoms, alkenyl group, cycloalkyl group, aralkyl group or cycloalkenyl group (which may have substituents described above in $R_{15}$), an aryl group or heterocyclic group (which may have substituents described above in $R_{15}$), an alkoxycarbonyl group (for example, a methoxycarbonyl group, an ethoxycarbonyl group or a stearyloxycarbonyl group, etc.), an aryloxycarbonyl group (for example, a phenoxycarbonyl group or a naphthoxycarbonyl group, etc.), an aralkyloxycarbonyl group (for example, a benzyloxycarbonyl group, etc.), an alkoxy group (for example, a methoxy group, an ethoxy group or a heptadecyloxy group, etc.), an aryloxy group (for example, a phenoxy group or a tolyloxy group, etc.), an alkylthio group (for example, an ethylthio group or a dodecylthio group, etc.), an arylthio group (for example, a phenylthio group or an $\alpha$-naphthylthio group, etc.), a carboxy group, an acylamino group (for example, an acetylamino group or a 3-[(2,4-di-tert-amylphenoxy)acetamido]benzamido group, etc.), a diacylamino group, an N-alkylacylamino group (for example, an N-methylpropionamido group, etc.), an N-arylacylamino group (for example, an N-phenylacetamido group, etc.), a ureido group (for example, an N-arylureido group or an N-alkylureido group, etc.), a urethane group, a thiourethane group, an arylamino group (for example, a phenylamino group, an N-methylanilino group, a diphenylamino group, an N-acetylanilino group or a 2-chloro-5-tetradecanamidoanilino group, etc.), an alkylamino group (for example, an n-butylamino group, a methylamino group or a cyclohexylamino group, etc.), a cycloamino group (for example, a piperidino group or a pyrrolidino group, etc.), a heterocyclic amino group (for example, a 4-pyridylamino group or a 2-benzoxazolylamino group, etc.), an alkylcarbonyl group (for example, a methylcarbonyl group, etc.), an arylcarbonyl group (for example, a phenylcarbonyl group, etc.), a sulfonamido group (for example, an alkylsulfonamido group or an arylsulfonamido group, etc.), a carbamoyl group (for example, an ethylcarbamoyl group, a dimethylcarbamoyl group, an N-methylphenylcarbamoyl group or an N-phenylcarbamoyl group, etc.), a sulfamoyl group (for example, an N-alkylsulfamoyl group, an N,N-dialkylsulfamoyl group, an N-arylsulfamoyl group, an N-alkyl-N-arylsulfamoyl group or an N,N-diarylsulfamoyl group, etc.), a cyano group, a hydroxy group, a mercapto group, a halogen atom or a sulfo group.

In the formula, $R_{17}$ represents a hydrogen atom, a straight chain or branched chain alkyl group having 1 to 32 carbon atoms, preferably 1 to 22 carbon atoms, an alkenyl group, a cycloalkyl group, an aralkyl group or a cycloalkenyl group, which may have the substituents described above in $R_{15}$.

Further, $R_{17}$ may represent an aryl group or a heterocyclic group, which may have substituents described above in $R_{15}$.

Further, $R_{17}$ may represent a cyano group, an alkoxy group, an aryloxy group, a halogen atom, a carboxy group, an alkoxycarbonyl group, an aryloxycarbonyl group, an acyloxy group, a sulfo group, a sulfamoyl group, a carbamoyl group, an acylamino group, a diacylamino group, a ureido group, a urethane group, a sulfonamido group, an arylsulfonyl group, an alkylsulfonyl group, an arylthio group, an alkylthio group, an alkylamino group, a dialkylamino group, an anilino group, an N-arylanilino group, an N-alkylanilino group, an N-acylanilino group, a hydroxy group or a mercapto group.

$R_{18}$, $R_{19}$ and $R_{20}$ represent each a group used for conventional 4-equivalent type phenol or α-naphthol couplers. Concretely, $R_{18}$ represents a hydrogen atom, a halogen atom, an aliphatic hydrocarbon residue, an acylamino group, —O—$R_{21}$ or —S—$R_{21}$ (wherein $R_{21}$ represents an aliphatic hydrocarbon residue). When two or more $R_{18}$ are present in the same molecule, they may each represent different groups. The aliphatic hydrocarbon residue may have substituents. $R_{19}$ and $R_{20}$ each represents a group selected from the group consisting of aliphatic hydrocarbon residues, aryl groups and heterocyclic groups, or one of them may represent a hydrogen atom. Further, they may have substituents. Further, $R_{19}$ and $R_{20}$ may form a nitrogen containing heterocyclic nucleus by linking together. l represents an integer of 1 to 4, m represents an integer of 1 to 3, and n represents an integer of 1 to 5. The aliphatic hydrocarbon residue may be saturated or unsaturated, and it may be any of a straight chain group, a branched chain group and a cyclic group. Preferably, it is an alkyl group (for example, a methyl, ethyl, propyl, isopropyl, butyl, t-butyl, isobutyl, dodecyl, octadecyl, cyclobutyl or cyclohexyl group) or an alkenyl group (for example, an allyl or octenyl group). Examples of the aryl group include a phenyl group and a naphthyl group. Typical examples of the heterocyclic group include pyridinyl, quinolyl, thienyl, piperidyl and imidazolyl groups. Examples of substituents introduced into the aliphatic hydrocarbon residues, the aryl groups and the heterocyclic groups include halogen atoms, nitro, hydroxy, carboxy, amino, substituted amino, sulfo, alkyl, alkenyl, aryl, heterocyclic, alkoxy, aryloxy, arylthio, arylazo, acylamino, carbamoyl, ester, acyl, acyloxy, sulfonamido, sulfamoyl, sulfonyl and morpholino groups.

The substituents $R_{11}$, $R_{12}$, $R_{13}$, $R_{14}$, $R_{15}$, $R_{17}$, $R_{18}$, $R_{19}$ and $R_{20}$ in couplers represented by the general formulae (IA) to (VIIIA) may be bonded to one another, or any of them represents a divalent group so as to form a symmetric or asymmetric complex coupler.

Examples of the diffusible DIR compounds suitably used in the present invention are as follows.

D-1

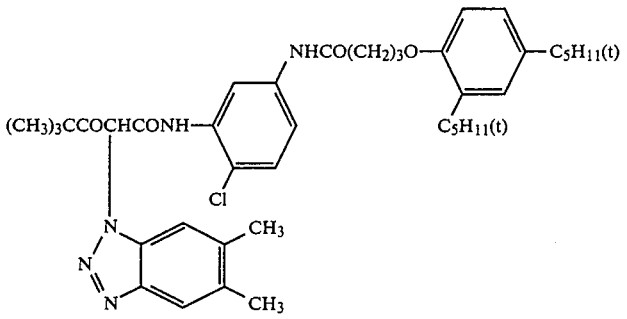

D-2

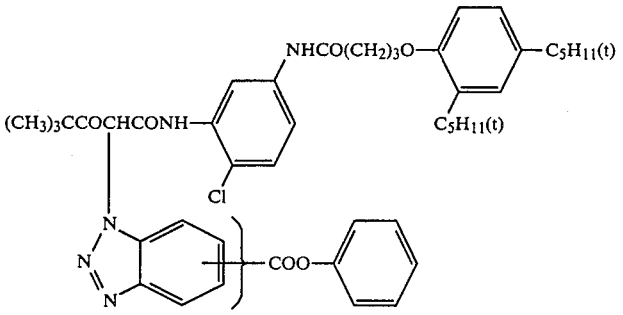

D-3

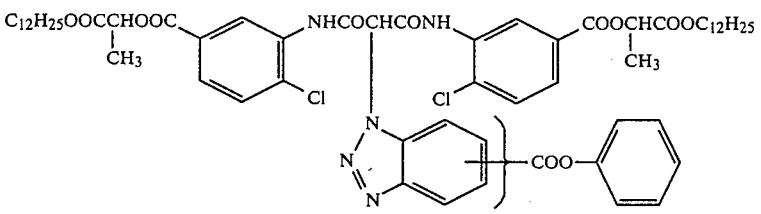

-continued
D-4
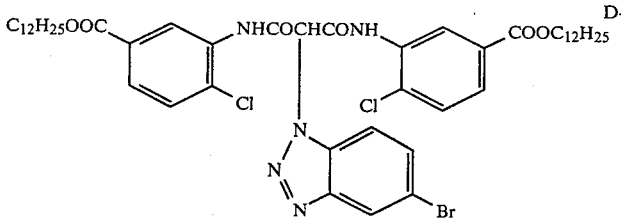
D-5
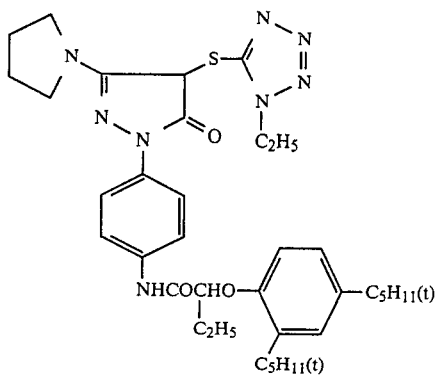
D-6
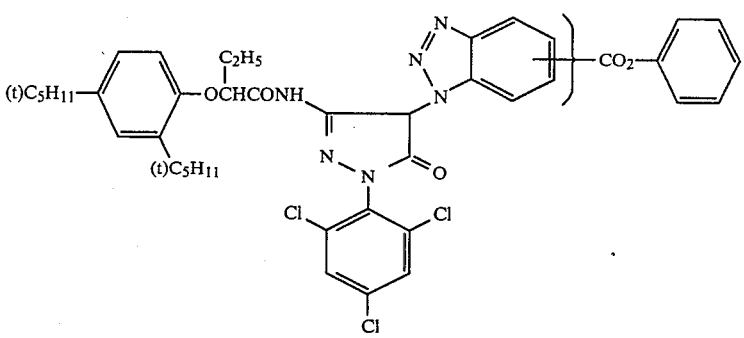
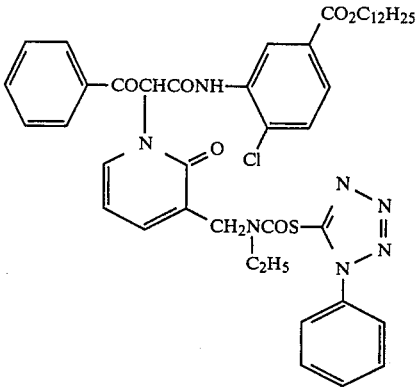
D-7
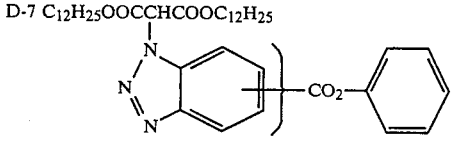
D-8
D-9
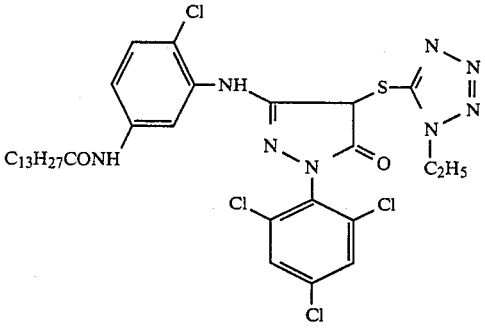
D-10
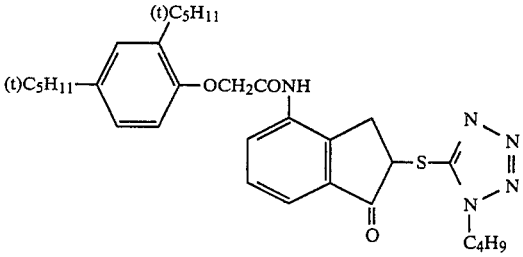

-continued
D-11
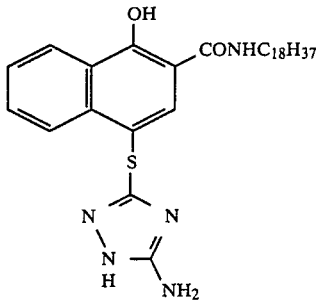
D-12
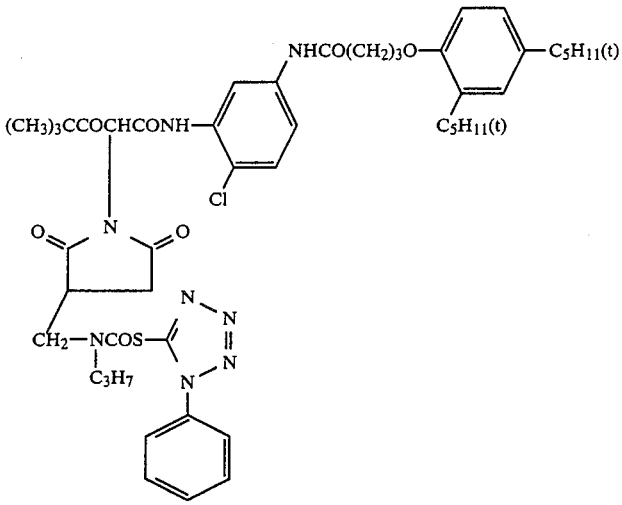
D-13
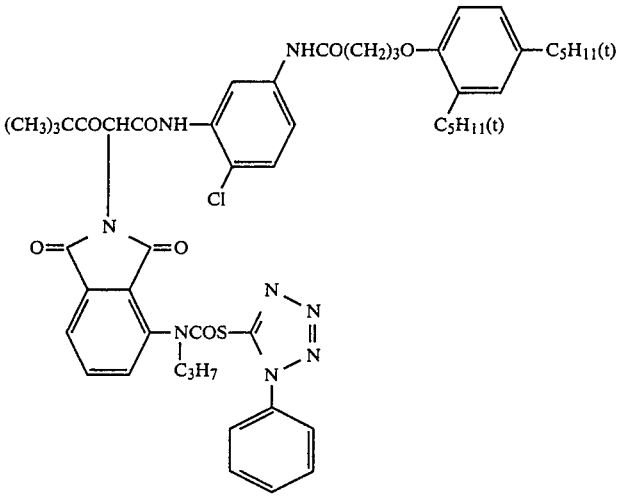
D-14
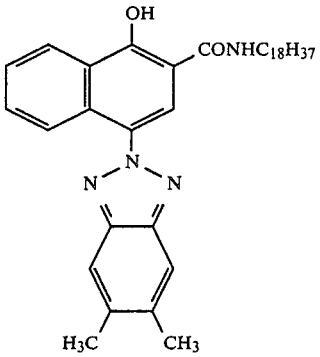
D-15
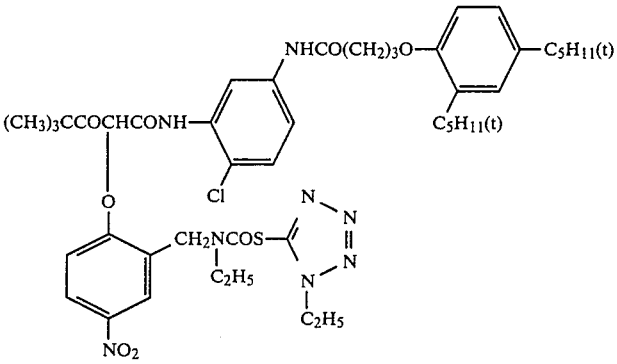

-continued
D-16
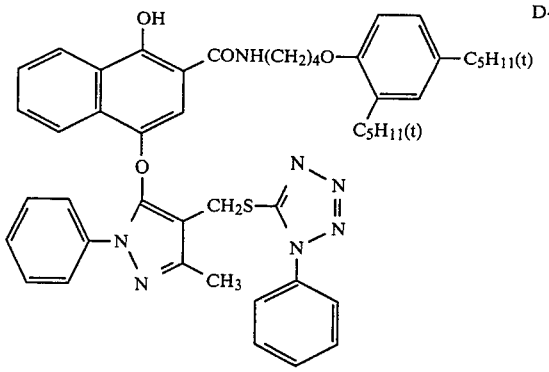
D-17
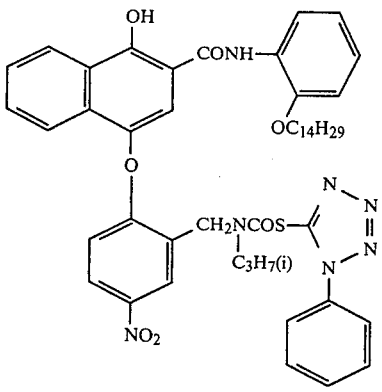
D-18
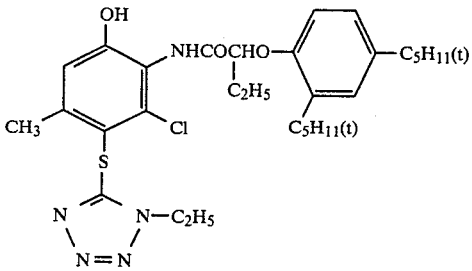
D-19
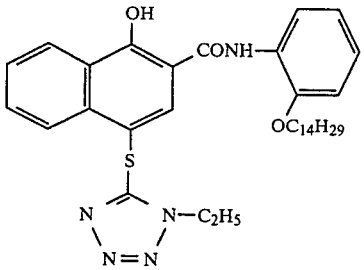
D-20
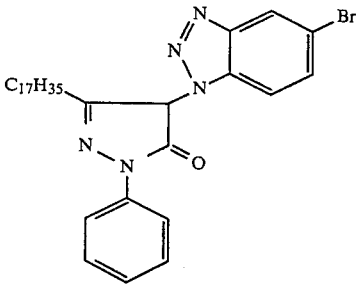
D-21
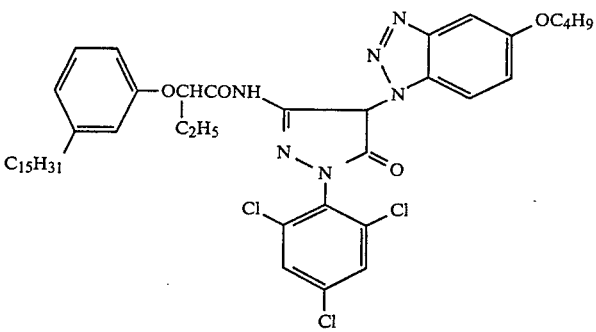
D-22
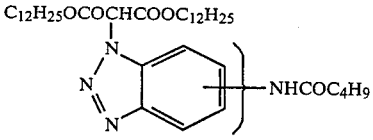
D-23
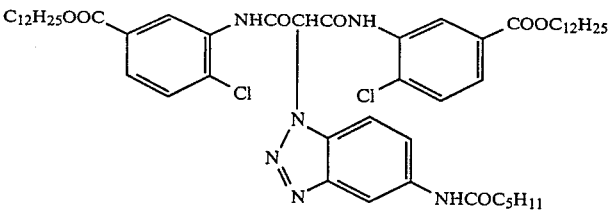

-continued
D-24
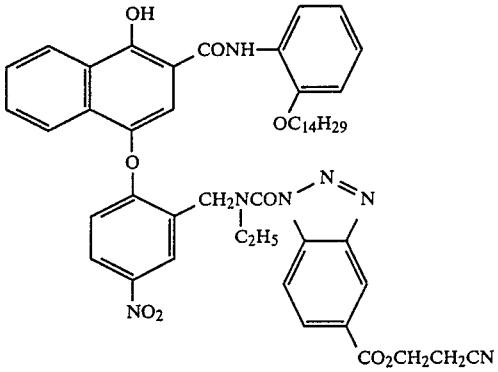
D-25
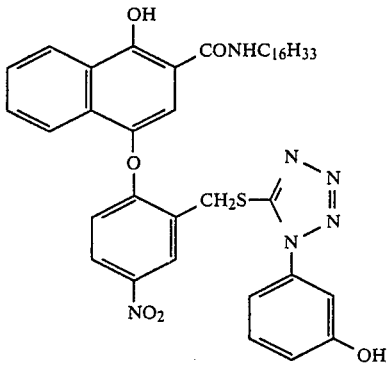
D-26
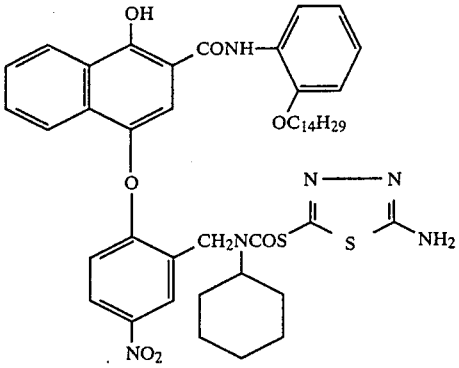
D-27
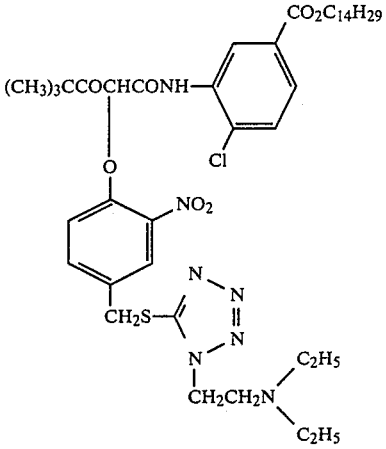
D-28
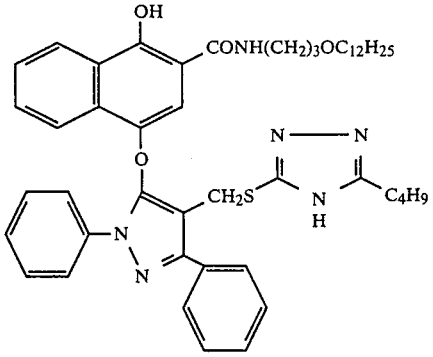
D-29
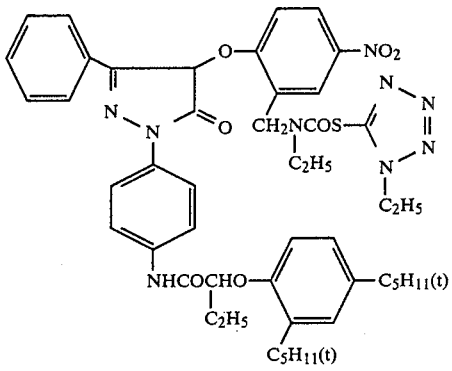
D-30
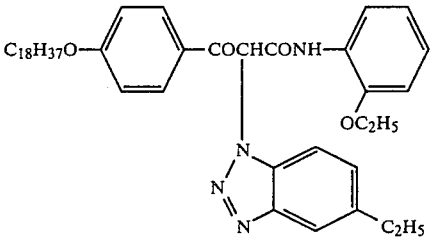
D-31
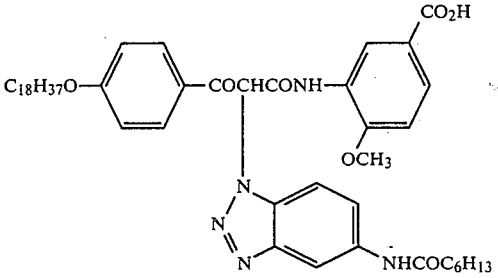

-continued
D-32
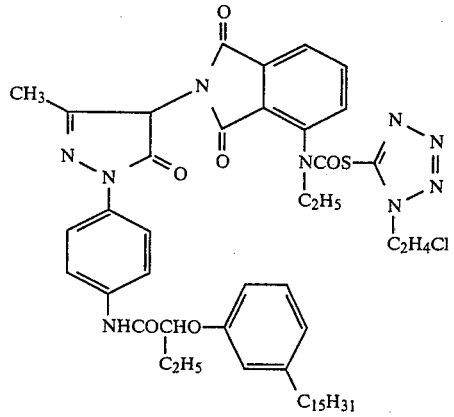
D-33
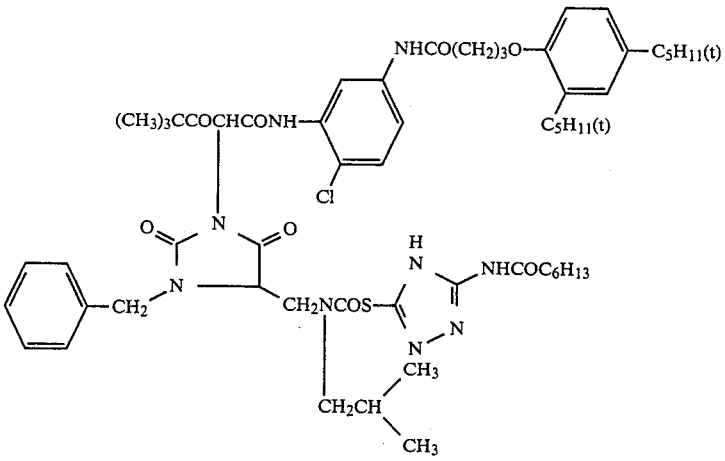
D-34
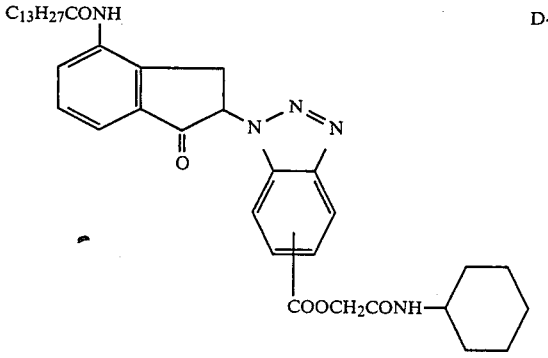
D-35
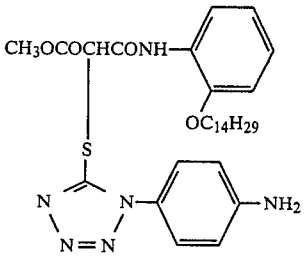

-continued
D-36
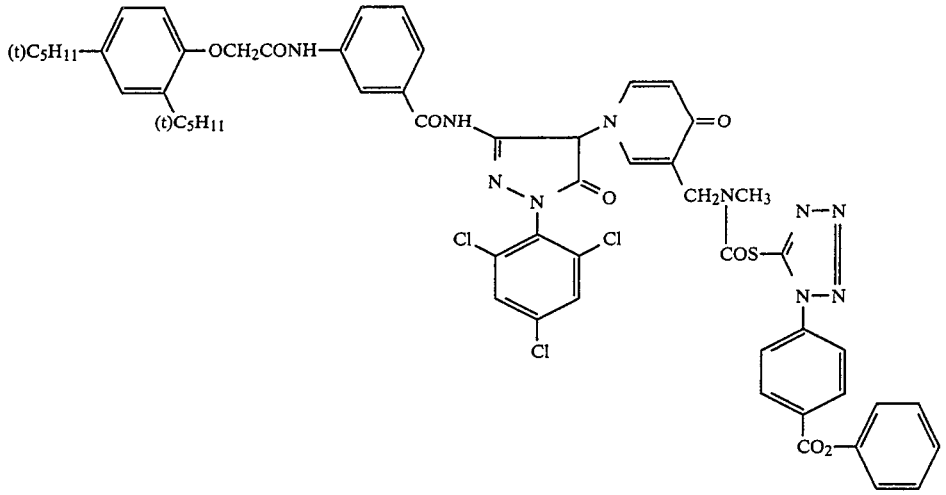
D-37
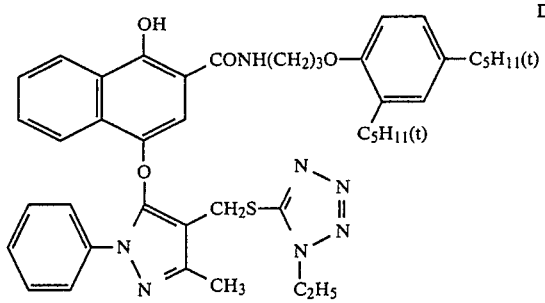
D-38
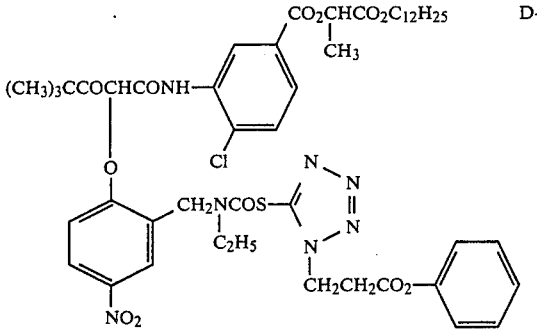
D-39
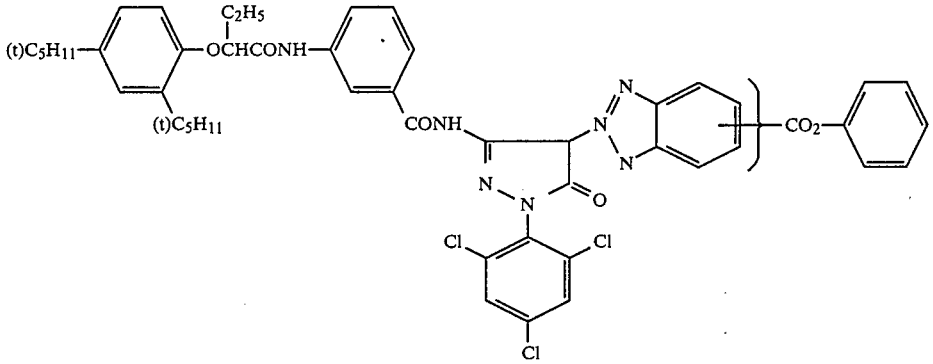
D-40
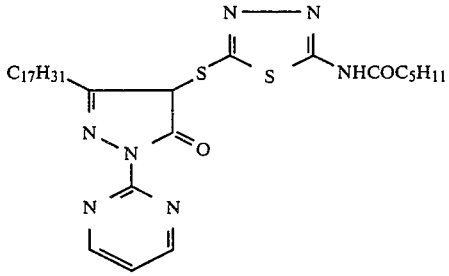
D-41
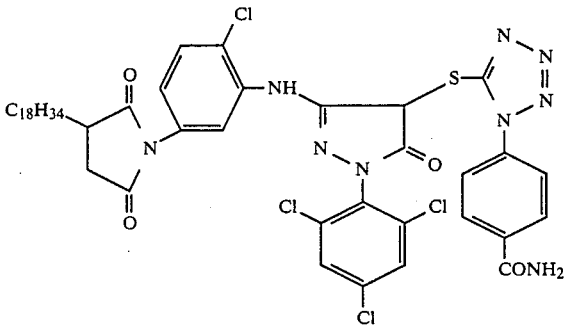

-continued

D-42

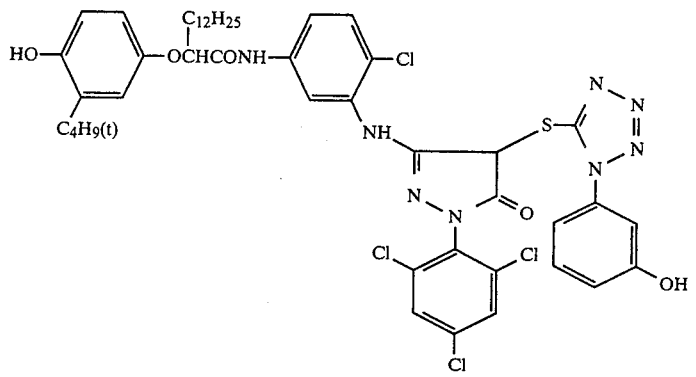

D-43

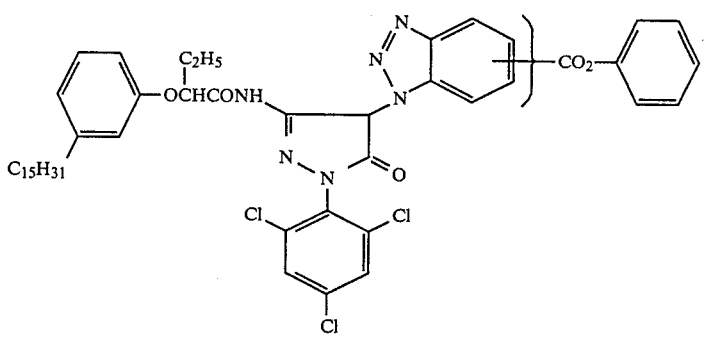

D-44

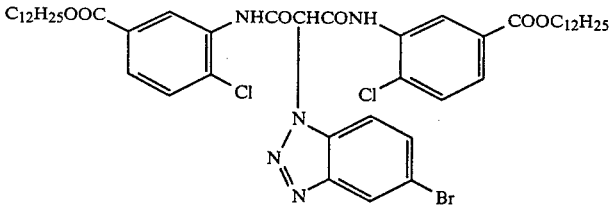

D-45

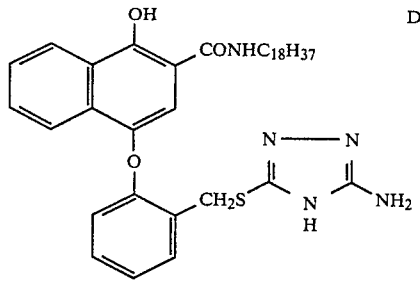

These compounds according to the present invention can be easily synthesized by processes described in U.S. Pat. Nos. 4,234,678, 3,227,554, 3,617,291, 3,958,993, 4,149,886 and 3,933,500, Japanese Patent Applications (OPI) Nos. 56837/82 and 13239/76, British Pat. Nos. 2,072,363 and 2,070,266, and *Research Disclosure*, December 1981, No. 21228, etc.

In order to introduce the couplers into silver halide emulsion layers, known processes, for example, the process described in U.S. Pat. No. 2,322,027, etc., can be used. For example, they are dispersed in hydrophilic colloids after dissolved in phthalic acid alkyl esters (dibutyl phthalate or dioctyl phthalate, etc.), phosphoric acid esters (diphenyl phosphate, triphenyl phosphate, tricresyl phosphate or dioctylbutyl phosphate), citric acid esters (for example, tributyl acetyl citrate), benzoic acid esters (for example, octyl benzoate), alkylamide (for example, diethyllaurylamide), aliphatic acid esters (for example, dibutoxyethyl succinate or dioctyl azelate) or trimesic acid esters (for example, tributyl trimesate), etc., or organic solvents having a boiling point of about 30° C. to 150° C., such as lower alkyl acetate such as ethyl acetate or butyl acetate, ethyl propionate, secondary butyl alcohol, methyl isobutyl ketone, β-ethoxyethyl acetate or methyl cellosolve acetate, etc. The above-described organic solvents having a high boiling point may be used as a mixture with organic solvents having a low boiling point.

Further, it is possible to use a process for dispersing using polymers described in Japanese Patent Publication No. 39853/76 and Japanese Patent Application (OPI) No. 59943/76.

When the couplers have acid groups such as carboxylic acid or sulfonic acid groups, they are introduced into hydrophilic colloids as an aqueous alkaline solution.

As a binder or a protective colloid for photographic emulsions, gelatin is advantageously used, but other hydrophilic colloids may be used.

For example, it is possible to use proteins such as gelatin derivatives, graft polymers of gelatin with another high polymer, albumin or casein, etc.; saccharide derivatives such as cellulose derivatives such as hydroxyethyl cellulose, carboxymethyl cellulose or cellulose sulfate, etc., sodium alginate or starch derivatives, etc.; and various synthetic hydrophilic high molecular substances such as homopolymers or copolymers, for example, polyvinyl alcohol, polyvinyl alcohol partial acetal, poly-N-vinylpyrrolidone, polyacrylic acid, polymethacrylic acid, polyacrylamide, polyvinylimidazole or polyvinylpyrazole, etc.

As gelatin, not only lime-treated gelatin but also acid-treated gelatin and enzyme-treated gelatin described in *Bull. Soc. Sci. Phot. Japan,* No. 16, p. 30 (1966) may be used. Further, hydrolyzed products and enzymatic decomposition products of gelatin can also be used. As gelatin derivatives, those which are obtained by reacting gelatin with various compounds such as acid halides, acid anhydrides, isocyanates, bromoacetic acid, alkanesultones, vinyl sulfonamides, maleinimides, polyalkylene oxides or epoxy compounds, etc., are used. Examples of them have been described in U.S. Pat. Nos. 2,614,928, 3,132,945, 3,186,846 and 3,312,553, British Pat. Nos. 861,414, 1,033,189 and 1,005,784, and Japanese Patent Publication No. 26845/67.

As the above-described gelatin graft polymers, it is possible to use those which are obtained by grafting homo- or copolymers of vinyl monomers such as acrylic acid, methacrylic acid, derivatives thereof such as esters or amides, etc., acrylonitrile or styrene, etc., on gelatin. Particularly, it is preferred to use graft polymers obtained using polymers having a certain degree of compatibility with gelatin, for example, polymers of acrylic acid, methacrylic acid, acrylamide, methacrylamide or hydroxyalkyl methacrylate, etc. Examples of them have been described in U.S. Pat. Nos. 2,763,625, 2,831,767 and 2,956,884, etc.

Typical synthetic hydrophilic high molecular substances are those described in, for example, German Patent Application (OLS) No. 2,312,708, U.S. Pat. Nos. 3,620,751 and 3,879,205, and Japanese Patent Publication No. 7561/68.

In the photographic emulsion layers in the photographic light-sensitive materials used in the present invention, any of silver bromide, silver iodobromide, silver iodochlorobromide, silver chlorobromide and silver chloride may be used as silver halide. Preferred silver halide is silver iodobromide containing 15% by mol or less of silver iodide. Particularly preferred silver halide is silver iodobromide containing 2% by mol to 14% by mol of silver iodide. The shape, the particle size and the distribution of particle size of emulsion particles, the process of forming particles, and chemical sensitization, etc., are the same as those described in preparation of emulsions for the colorsensitive layers containing a specified silver iodide content according to the present invention, except that the description concerning silver iodide content.

In order to prevent fogging in the process for producing the light-sensitive materials, during preservation or during photographic processing, or to stabilize photographic properties, various compounds can be added to the photographic emulsions used in the present invention. Namely, it is possible to add many compounds known as antifogging agents or stabilizers, such as azoles, for example, benzothiazolium salts, nitroimidazoles, triazoles, benzotriazoles and benzimidazoles (particularly, nitro- or halogen-substituted derivatives); heterocyclic mercapto compounds, for example, mercaptothiazoles, mercapto benzimidazoles, mercaptothiadiazoles, mercaptotetrazoles (particularly, 1-phenyl-5-mercaptotetrazole) and mercaptopyrimidines; the above-described heterocyclic mercapto compounds having water solubilizing groups such as carboxy group or sulfonic acid group, etc.; thioketo compounds, for example, oxazolinethione; azaindenes, for example, tetraazaindenes (particularly, 4-hydroxy substituted (1,3,3a,7)tetraazaindenes); benzenethiosulfonic acids; benzenesulfinic acids and the like.

More detailed examples of them and the method of using them can be referred to descriptions of, for example, U.S. Pat. Nos. 3,954,474, 3,982,947, 4,021,248 and Japanese Patent Publication No. 28660/77.

The photographic emulsion layers or other hydrophilic colloid layers in the light-sensitive materials according to the present invention may contain various surface active agents for various purposes, for example, as coating aids or for prevention of static charges, improvement of a lubricating property, emulsifying dispersion, prevention of adhesion and improvement of photographic characteristics (for example, development acceleration, hard toning and sensitization, etc.).

For example, it is possible to use nonionic surface active agents such as saponin (steroid type), alkylene oxide derivatives (for example, polyethylene glycol, polyethylene glycol/polypropylene glycol condensates, polyethylene glycol alkyl esters, polyethylene glycol alkylaryl ethers, polyethylene glycol esters, polyethylene glycol sorbitan esters, polyalkylene glycol alkylamines or amides, and polyethylene oxide addition products of silicone), glycidol derivatives (for example, alkenylsuccinic acid polyglyceride and alkylphenol polyglyceride), aliphatic acid esters of polyhydric alcohols or alkyl esters of saccharides, etc.; anionic surface active agents containing acid groups such as carboxy group, sulfonic acid group, phosphonic acid group, sulfuric acid ester group or phosphoric acid ester group, etc., such as alkylcarboxylic acid salts, alkylsulfonic acid salts, alkylbenzenesulfonic acid salts, alkylnaphthalenesulfonic acid salts, alkyl sulfuric acid ester, alkylphosphoric acid esters, N-acyl-N-alkyltaurines, sulfosuccinic acid esters, sulfoalkyl polyoxyethylene alkylphenyl ethers or polyoxyethylene alkylphosphoric acid esters, etc.; ampholytic surface active agents such as amino acids, aminoalkylsulfonic acids, aminoalkyl sulfuric or phosphoric acid esters, alkyl betaines or amineoxides, etc.; and cationic surface active agents such as alkylamine salts, aliphatic or aromatic quaternary ammonium salts, heterocyclic quaternary ammonium salts such as pyridinium or imidazolium salts, or aliphatic or heterocyclic phosphonium or sulfonium salts, etc.

The emulsion layers in the photographic light-sensitive materials produced according to the present invention may contain, for example, polyalkylene oxides or derivatives thereof such as ethers, esters or amines, etc., thioether compounds, thiomorpholines, quaternary ammonium salts, urethane derivatives, urea derivatives, imidazole derivatives or 3-pyrazolidones, etc., for the purpose of increasing sensitivity, improving contrast or accelerating development. For example, it is possible to use those described in U.S. Pat. Nos. 2,400,532, 2,423,549, 2,716,062, 3,617,280, 3,772,021 and 3,808,003 and British Pat. No. 1,488,991, etc.

In the photographic light-sensitive materials produced according to the present invention, the photographic emulsion layers and other hydrophilic colloid layers may contain dispersions of water-insoluble or poorly soluble synthetic polymers for the purpose of improving dimensional stability. For example, it is possible to use polymers composed of one or more of alkyl acrylate, alkyl methacrylate, alkoxyalkyl acrylate, alkoxyalkyl methacrylate, glycidyl acrylate, glycidyl methacrylate, acrylamide, methacrylamide, vinyl esters (for example, vinyl acetate), acrylonitrile, olefins and styrene, etc., and polymers composed of the above-described monomer components and acrylic acid, methacrylic acid, $\alpha,\beta$-unsaturated dicarboxylic acid, hydroxyalkyl acrylate, hydroxyalkyl methacrylate, sulfoalkyl acrylate, sulfoalkyl methacrylate or styrenesulfonic acid, etc. For example, it is possible to use those described in U.S. Pat. Nos. 2,376,005, 2,739,137, 2,853,457, 3,062,674, 3,411,911, 3,488,708, 3,525,620, 3,607,290, 3,635,715 and 3,645,740 and British Pat. Nos. 1,186,699 and 1,307,373.

In order to carry out photographic processing of layers composed of the photographic emulsions produced according to the present invention, known methods and known processing solutions can be used. This photographic processing may be that which forms dye images (color photographic processing) according to the purpose. The processing temperature is generally selected from the range of 18° C. to 50° C., but a temperature of less than 18° C. or a temperature of more than 50° C. may be used.

As a special mode of development processing, it is possible to use a process which comprises carrying out development by treating a light-sensitive material containing a developing agent in, for example, an emulsion layer thereof with an aqueous alkaline solution. Of the developing agents, hydrophobic agents can be incorporated in the emulsion layer by methods described in *Research Disclosure,* No. 169 (RD-16928), U.S. Pat. No. 2,739,890, British Pat. No. 813,253 and German Pat. No. 1,547,763, etc. Such a developing processing may be combined with a silver salt stabilization processing using thiocyanic acid salts.

As a fixing solution, those having a composition conventionally used can be used. Useful fixing agents include not only thiosulfuric acid salts and thiocyanic acid salts but also organic sulfur compounds which are known to have an effect as a fixing agent. The fixing solution may contain water-soluble aluminum salts as a hardener.

When forming dye images, conventional processes can be utilized. For example, a negative-positive process can be used (for example, *Journal of the Society of Motion Picture and Television Engineers,* Vol. 61 (1953), pp. 667 to 701).

The color developing solution generally consists of an aqueous alkaline solution containing a color developing agent. As the color developing agents, it is possible to use known primary aromatic amine developing agents, for example, phenylenediamines (for example, 4-amino-N,N-diethylaniline, 3-methyl-4-amino-N,N-diethylaniline, 4-amino-N-ethyl-N-$\beta$-hydroxyethylaniline, 3-methyl-4-amino-N-ethyl-N-$\beta$-hydroxyethylaniline, 3-methyl-4-amino-N-ethyl-N-$\beta$-methanesulfonamidoethylaniline and 4-amino-3-methyl-N-ethyl-N-$\beta$-methoxyethylaniline, etc.).

In addition, substances described in L. F. A. Mason, *Photographic Processing Chemistry* (published by Focal Press, 1966), pp. 226 to 229, U.S. Pat. Nos. 2,193,015 and 2,592,364 and Japanese Patent Application (OPI) No. 64933/73, etc., may be used.

The color developing solution may contain pH buffer agents, development inhibitors and antifogging agents, etc., in addition to the above-described substances. Further, it may contain, if necessary, water softeners, preservatives, organic solvents, development accelerators, dye forming couplers, competing couplers, fogging agents, auxiliary developing agents, viscosity increasing agents, polycarboxylic acid type chelating agents and antioxidants, etc.

Examples of these additives have been described in *Research Disclosure,* (RD-17643) and U.S. Pat. No. 4,083,723 and German Patent Application (OLS) No. 2,622,950, etc.

The photographic emulsion layers after development are generally subjected to a bleach processing. The bleach processing may be carried out simultaneously with a fixation processing or may be carried out separately.

As bleaching agents, compounds of polyvalent metal such as iron (III), cobalt (III), chromium (VI) or copper (II), etc., peracids, quinones and nitroso compounds, etc., are used.

For example, it is possible to use ferricyanides; bichromates, organic complex salts of iron (III) and cobalt (III), for example, complex salts of organic acids such as aminopolycarboxylic acids such as ethylenediaminetetraacetic acid, nitrilotriacetic acid or 1,3-diamino-2-propanol-tetraacetic acid, etc., citric acid, tartaric acid or malic acid, etc.; persulfates and permanganates; and nitrosophenols, etc. Among them, potassium ferricyanide, (ethylenediaminetetraacetato) iron (III) sodium salt and (ethylenediaminetetraacetato) iron (III) ammonium salt are particularly useful. (Ethylenediaminetetraacetato) iron (III) complex salts are useful in both the bleaching solution and the one-bath bleach-fixing solution.

To the bleaching solution or the bleach-fixing solution, it is possible to add various additives including bleach accelerators described in U.S. Pat. Nos. 3,042,520 and 3,241,966 and Japanese Patent Publications Nos. 8506/70 and 8836/70, etc., and thiol compounds described in Japanese Patent Application (OPI) No. 65732/78.

The photographic emulsions used in the present invention may be spectrally sensitized with methine dyes or others.

Effective sensitizing dyes are those described in, for example, German Pat. No. 929,080, U.S. Pat. Nos. 2,493,748, 2,503,776, 2,519,001, 2,912,329, 3,656,959, 3,672,897 and 4,025,349, British Pat. No. 1,242,588 and Japanese Patent Publication No. 14030/69.

These sensitizing dyes may be used alone, but they can be used as a combination of two or more of them. The combination of the sensitizing dyes is often used for the purpose of supersensitization. Examples of them have been described in U.S. Pat. Nos. 2,688,545, 2,977,229, 3,397,060, 3,522,052, 3,527,641, 3,617,293, 3,628,964, 3,666,480, 3,672,898, 3,679,428, 3,814,609 and 4,026,707, British Pat. No. 1,344,281, Japanese Patent Publications Nos. 4936/68 and 12375/78 and Japanese Patent Applications (OPI) Nos. 110618/77 and 109925/77.

In the photographic light-sensitive materials produced according to the present invention, the photographic emulsion layers and the other layers are formed by applying to flexible bases conventionally used for photographic light-sensitive materials, such as plastic films, paper or cloth, etc., or rigid bases such as glass, porcelain or metal, etc. Examples of useful flexible bases include films composed of semisynthetic or synthetic high polymers such as cellulose nitrate, cellulose acetate, cellulose acetate butyrate, polystyrene, polyvinyl chloride, polyethylene terephthalate or polycarbonate, etc., and papers coated or laminated with a baryta layer or α-olefin polymers (for example, polyethylene, polypropylene or ethylene/butene copolymer), etc. The bases may be colored with dyes or pigments. They may be blacked for the purpose of shielding the light. The surface of these bases is generally undercoated for the purpose of improving adhesion to the photographic emulsion layer, etc. The surface of bases may be subjected to corona discharge, irradiation of ultraviolet rays or flame treatment, etc., before or after the undercoating treatment.

As layer constructions of the light-sensitive materials capable of showing the effect of the present invention, there is not only the conventional layer construction which is obtained by applying a colloidal silver antihalation layer, an intermediate layer, a low speed red-sensitive layer, a high speed red-sensitive layer, an intermediate layer, a low speed green-sensitive layer, a high speed green-sensitive layer, a yellow filter layer, a low speed blue-sensitive layer, a high spedd blue-sensitive layer and a protective layer to a base in turn, but also a layer construction wherein at least one of the red-sensitive layer, the green-sensitive layer and the blue-sensitive layer is divided into three layer parts as described in Japanese Patent Publication No. 15495/74, a layer construction wherein a high speed emulsion unit layer and a low speed emulsion unit layer are separated as described in Japanese Patent Application (OPI) No. 49027/76 and layer constructions described in German Patent Applications (OLS) Nos. 2,622,922, 2,622,923, 2,622,924, 2,704,826 and 2,704,797, etc. However, the present invention is not limited to them.

In addition to the above-described layer constructions, the effect of the present invention is also shown when providing additional assistant layers, for example, an intermediate layer containing colloidal silver, an intermediate layer containing an emulsion of fine particles having an average particle size of 0.3μ or less or an intermediate layer containing a coloring coupler and/or a non-coloring coupler.

Exposure for obtaining photographic images is sufficiently carried out by conventional methods. Namely, it is possible to use various known light sources such as natural light (sunlight), a tungsten lamp, a fluorescent lamp, a mercury lamp, a xenon arc lamp, a carbon arc lamp, a xenon flash lamp or a cathode-ray tube flying spot, etc. As the time of exposure, it is possible to use not only a range of 1/1,000 second to 1 second, which is used for conventional cameras, but also exposure for less than 1/1,000 second, for example, exposure for $1/10^4$ to $1/10^6$ second when using a xenon flash lamp or a cathode-ray tube, and exposure for more than 1 second. If necessary, the spectral composition of light used for exposure can be controlled by color filters. Laser rays can be used for exposure, too. Further, the exposure may be carried out by light emitted from fluorescent substances excited by electron rays, X-rays, γ-rays or α-rays, etc.

In the photographic emulsion layers of the photographic light-sensitive materials produced according to the present invention, color forming couplers, namely, compounds capable of coloring by oxidative coupling with an aromatic primary amine developing agent (for example, phenylenediamine derivatives or aminophenol derivatives, etc.) are used together. For example, there are 5-pyrazolone couplers, pyrazolobenzimidazole couplers, cyanoacetyl coumarone couplers and ring-opened acylacetonitrile couplers, etc., as magenta couplers, acylacetamide couplers (for example, benzoylacetanilides and pivaloylacetanilides), etc., as yellow couplers, and naphthol couplers and phenol couplers, etc., as cyan couplers. It is preferred that these couplers are non-diffusible, which have hydrophobic groups called ballast groups in the molecule. The couplers may be any of 4-equivalent ones and 2-equivalent ones to silver ion. Further, they may be colored couplers which have an effect of color correction or may be couplers which release a development inhibitor during development (the so-called DIR couplers).

Moreover, they may contain non-coloring DIR coupling compounds wherein the coupling reaction product is colorless and a development inhibitor is released, other than the DIR couplers.

Examples of the magenta color couplers include those described in U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445, German Pat. No. 1,810,464, German Patent Applications (OLS) Nos. 2,408,665, 2,417,945, 2,418,959 and 2,424,467, Japanese Patent Publication No. 6031/65, and Japanese Patent Applications (OPI) Nos. 20826/76, 58922/77, 129538/74, 74027/74, 159336/75, 42121/77, 74028/74, 60233/75, 26541/76 and 55122/78, etc.

Examples of the yellow color couplers include those described in U.S. Pat. Nos. 2,875,057, 3,265,506, 3,408,194, 3,551,155, 3,582,322, 3,725,072 and 3,891,445, German Pat. No. 1,547,868, German Patent Applications (OLS) Nos. 2,219,917, 2,261,361 and 2,414,006, British Pat. No. 1,425,020, Japanese Patent Publication No. 10783/76, and Japanese Patent Applications (OPI) Nos. 26133/72, 73147/73, 102636/72, 6341/75, 123342/75, 130442/75, 21827/76, 87650/75, 82424/77 and 115219/77, etc.

Examples of the cyan color couplers include those described in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411 and 4,004,929, German Patent Applications (OLS) Nos. 2,414,830 and 2,454,329, and Japanese Patent Applications (OPI) Nos. 59838/73, 26034/76, 5055/73, 146828/76, 69624/77 and 90932/77.

Examples of the colored couplers include those described in U.S. Pat. Nos. 3,476,560, 2,521,908 and 3,034,892, Japanese Patent Publications Nos. 2016/69, 22335/63, 11304/67 and 32461/69, Japanese Patent Applications (OPI) Nos. 26034/76 and 42121/77, and German Patent Application (OLS) No. 2,418,959.

Examples of the DIR couplers include those described in U.S. Pat. Nos. 3,227,554, 3,617,291, 3,701,783, 3,790,384 and 3,632,345, German Patent Applications (OLS) Nos. 2,414,006, 2,454,301 and 2,454,329, British Pat. No. 953,454, Japanese Patent Applications (OPI) Nos. 69624/77 and 122335/74 and Japanese Patent Publication No. 16141/76.

The light-sensitive materials may contain compounds which release a development inhibitor during development in addition to the DIR couplers. For example, it is possible to use those described in U.S. Pat. Nos. 3,297,445 and 3,379,529, German Patent Application (OLS) No. 2,417,914 and Japanese Patent Applications (OPI) Nos. 15271/77 and 9116/78.

In the photographic light-sensitive materials produced according to the present invention, the photographic emulsion layers and other hydrophilic colloid layers may contain inorganic or organic hardeners.

Examples of them include chromium salts (chromium alum and chromium acetate, etc.), aldehydes (formaldehyde, glyoxal and glutaraldehyde, etc.), N-methylol compounds (dimethylolurea and methyloldimethylhydantoin, etc.), dioxane derivatives (2,3-dihydroxydioxane, etc.), acetive vinyl compounds (1,3,5-triacryloylhexahydro-s-triazine and 1,3-vinylsulfonyl-2-propanol, etc.), active halogen compounds (2,4-dichloro-6-hydroxy-s-triazine, etc.) and mucohalogenic acids (mucochloric acid and mucophenoxychloric acid, etc.), which can be used alone or as a combination thereof.

In the light-sensitive materials produced according to the present invention, the hydrophilic colloid layers may be mordanted with cationic polymers, when they contain dyes or ultraviolet ray absorbing agents. For example, it is possible to use polymers described in British Pat. No. 685,475, U.S. Pat. Nos. 2,675,316, 2,839,401, 2,882,156, 3,048,487, 3,184,309 and 3,445,231, German Patent Application (OLS) No. 1,914,362 and Japense Patent Applications (OPI) Nos. 47624/75 and 71332/75, etc.

The light-sensitive materials produced according to the present invention may contain hydroquinone derivatives, aminophenol derivatives, gallic acid derivatives and ascorbic acid derivatives, etc., as anti-color-fogging agents.

In the light-sensitive materials produced according to the present invention, the hydrophilic colloid layers may contain ultraviolet ray absorbing agents. For example, it is possible to use benzotriazole compounds substituted by an aryl group, 4-thiazolidone compounds, benzophenone compounds, cinnamic acid ester compounds, butadiene compounds, benzoxazole compounds and ultraviolet ray absorbing polymers, etc. Further, latex polymer ultraviolet ray absorbing agents can be advantageously used. These ultraviolet ray absorbing agents may be fixed in the above-described hydrophilic colloid layers.

Examples of the ultraviolet ray absorbing agents have been described in U.S. Pat. Nos. 3,533,794, 3,314,794 and 3,352,681, Japanese Patent Application (OPI) No. 2784/71, U.S. Pat. Nos. 3,705,805, 3,707,375, 4,045,229, 3,700,455 and 3,499,762 and German Pat. Application (OLS) No. 1,547,863, etc.

In the light-sensitive materials produced according to the present invention, the hydrophilic colloid layers may contain water-soluble dyes as filter dyes or for the purpose of preventing irradiation or others. Examples of such dyes include oxonol dyes, hemioxonol dyes, styryl dyes, merocyanine dyes, cyanine dyes and azo dyes. Particularly, oxonol dyes, hemioxonol dyes and merocyanine dyes are useful.

In carrying out the present invention, the following known anti-fading agents can be used together. Further, the color image stabilizers used in the present invention may be used alone or as a combination of two or more of them. Examples of the known anti-fading agents include hydroquinone derivatives, gallic acid derivatives, p-alkoxyphenols, p-oxyphenol derivatives and bisphenols, etc.

Examples of hydroquinone derivatives have been described in U.S. Pat. Nos. 2,360,290, 2,418,613, 2,675,314, 2,701,197, 2,704,713, 2,728,659, 2,732,300, 2,735,765, 2,710,801 and 2,816,028 and British Pat. No. 1,363,921, etc., those of gallic acid derivatives have been described in U.S. Pat. Nos. 3,457,079 and 3,069,262, etc., those of p-alkoxyphenols have been described in U.S. Pat. Nos. 2,735,765 and 3,698,909 and Japanese Patent Publications Nos. 20977/74 and 6623/77, those of p-oxyphenol derivatives have been described in U.S. Pat. Nos. 3,432,300, 3,573,050, 3,574,627 and 3,764,337 and Japanese Patent Applications (OPI) Nos. 35633/77, 147434/77 and 152225/77, and those of bisphenols have been described in U.S. Pat. No. 3,700,455,

EXAMPLE 4

A multilayer color light-sensitive material: Sample 101 consisting of layers having the following compositions was produced on a polyethylene terephthalate film base.

Sample 101

The 1st Layer: Antihalation Layer (AHL)

A gelatin layer containing black colloidal silver

The 2nd Layer: Intermediate Layer (ML)

A gelatin layer containing an emulsified dispersion of 2,5-di-t-octylhydroquinone The 3rd Layer: Red-Sensitive Low Speed Emulsion Layer ($RL_1$)

Silver iodobromide emulsion (monodisperse emulsion having silver iodide: 4% by mol and an average particle size: 0.65$\mu$), coating amount of silver: 1.65 g/m$^2$ Sensitizing Dye I: $6\times10^{-5}$ mol per mol of silver Sensitizing Dye II: $1.5\times10^{-5}$ mol per mol of silver Coupler C-1: 0.060 mol per mol of silver Coupler E-2: 0.003 mol per mol of silver Coupler D-3: 0.002 mol per mol of silver The 4th Layer: Red-Sensitive Medium Speed Emulsion Layer ($RL_2$)

Silver iodobromide emulsion (polydisperse emulsion having silver iodide: 3.5% by mol and average particle size: 0.85$\mu$), coating amount of silver: 1.25 g/m$^2$ Sensitizing Dye I: $4\times10^{-5}$ mol per mol of silver Sensitizing Dye II: $1\times10^{-5}$ mol per mol of silver Coupler C-1: 0.035 mol per mol of silver Coupler C-2: 0.015 mol per mol of silver Coupler E-2: 0.0025 mol per mol of silver Coupler D-3: 0.0015 mol per mol of silver The 5th Layer: Red-Sensitive High Speed Emulsion Layer ($RL_3$)

Silver iodobromide emulsion (polydisperse emulsion having silver iodide: 10.5% by mol and an average particle size: 1.2$\mu$)

Sensitizing Dye I: $2.5\times10^{-5}$ mol per mol of silver

Sensitizing Dye II: $0.6\times10^{-5}$ mol per mol of silver

Coupler C-1: 0.008 mol per mol of silver

Coupler C-2: 0.010 mol per mol of silver

Coupler E-2: 0.002 mol per mol of silver

The 6th Layer: Middle Layer (ML)

The same as the 2nd layer

The 7th Layer: Green-Sensitive Low Speed Emulsion Layer ($GL_1$)

Silver iodobromide emulsion (monodisperse emulsion having silver iodide: 6.5% by mol and an average particle size: 0.60$\mu$), coating amount of silver: 0.55 g/m$^2$ Sensitizing Dye III: $3\times10^{-5}$ mol per mol of silver Sensitizing Dye IV: $1\times10^{-5}$ mol per mol of silver Coupler M-1: 0.09 mol per mol of silver Coupler E-3: 0.01 mol per mol of silver Coupler E-1: 0.0015 mol per mol of silver The 8th Layer: Green-Sensitive Medium Speed Emulsion Layer ($GL_2$)

Silver iodobromide emulsion (polydisperse emulsion having silver iodide: 6.5% by mol and an average particle size: 0.80μ), coating amount of silver: 1.6 g/m²

Sensitizing Dye III: $2.5\times10^{-5}$ mol per mol of silver

Sensitizing Dye IV: $0.8\times10^{-5}$ mol per mol of silver

Coupler M-1: 0.03 mol per mol of silver

Coupler E-1: 0.001 mol per mol of silver

Coupler E-3: 0.003 mol per mol of silver

The 9th Layer: Green-Sensitive High Speed Emulsion Layer ($GL_3$)

Silver iodobromide emulsion (polydisperse emulsion having silver iodide: 7.0% by mol and an average particle size: 1.1μ), ocating amount of silver: 2.0 g/m²

Sensitizing Dye III $1.8\times10^{-5}$ mol per mol of silver

Sensitizing Dye IV $0.6\times10^{-5}$ mol per mol of silver

Coupler M-1 0.015 mol per mol of silver

Coupler E-3 0.003 mol per mol of silver

The 10th Layer: Yellow Filter Layer (YFL)

A gelatin layer containing yellow colloidal silver and an emulsified dispersion of 2,5-di-t-octylhydroquinone in an aqueous solution of gelatin The 11th Layer: The 1st Blue-Sensitive Emulsion Layer ($BL_1$)

Silver iodobromide emulsion (monodisperse emulsion having silver iodide: 5.5% by mol and an average particle size of 0.6μ), coating amount of silver: 0.4 g/m²

Coupler Y-1 0.25 mol per mol of silver

Coupler E-1 0.015 mol per mol of silver

The 12th Layer: Blue-Sensitive Medium Speed Emulsion Layer ($BL_2$)

Silver iodobromide emulsion (polydisperse emulsion having silver iodide: 7% by mol and an average particle size: 0.9μ), coating amount of silver: 0.3 g/m²

Coupler Y-1: 0.04 mol per mol of silver

The 13th Layer: Blue-Sensitive High Speed Emulsion Layer ($BL_3$)

Silver iodobromide emulsion (polydisperse emulsion having silver iodide: 7% by mol and an average particle size: 1.4μ), coating amount of silver: 0.75 g/m²

Coupler Y-1: 0.035 mol per mol of silver

The 14th Layer: The 1st Protective Layer ($PL_1$)

Silver iodobromide (silver iodide: 1% by mol, average particle size: 0.07μ), coating amount of silver: 0.5 g Gelatin containing an emulsified dispersion of the ultraviolet ray absorbing agent: UV-1

The 15th Layer: The 2nd Protective Layer ($PL_2$)

A gelatin layer containing trimethyl methacrylate particles (diameter: about 1.5μ)

To each layer, the antifogging agent: 5-methyl-7-hydroxy-1,3,4-triazaindolizine, the gelatin hardener: H-1 and surface active agents were added in addition to the above-described compositions.

The sample produced as described above was called Sample 101.

Compounds Used For Producing The Sample

Sensitizing Dye I: Anhydro-5,5'-dichloro-3,3'-di(γ-sulfopropyl)-9-ethyl-thiacarbocyanine hydroxide pyridinium salt Sensitizing Dye II: Anhydro-9-ethyl-3,3'-di(γ-sulfopropyl)-4,5,4',5'-dibenzothiacarbocyanine hydroxide triethylamine salt Sensitizing Dye III: Anhydro-9-ethyl-5,5'-dichloro-3,3'-di(γ-sulfopropyl)oxacarbocyanine sodium salt Sensitizing Dye IV: Anhydro-5,6,5',6'-tetrachloro-1,1'-diethyl-3,3'-di{β-[β-(γ-sulfopropoxy)ethoxy]ethylimidazolo}carbocyanine hydroxide sodium salt Coupler E-2

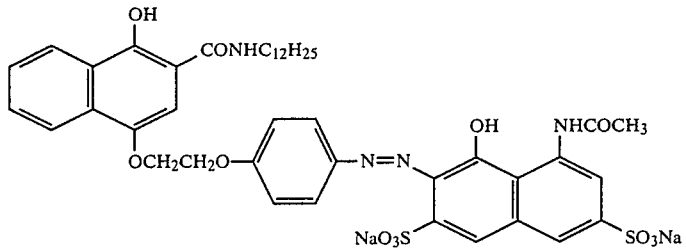

Coupler E-3

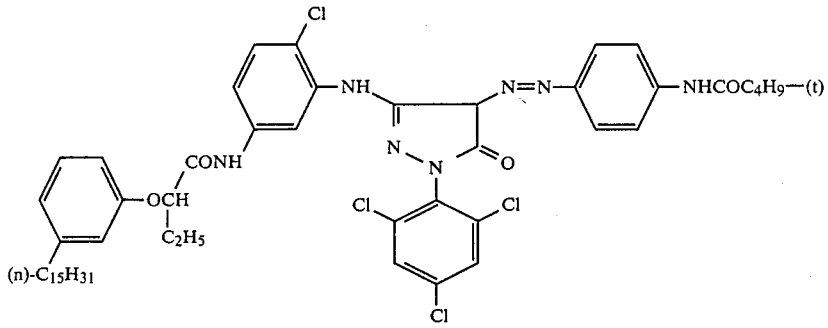

-continued

Coupler M-1

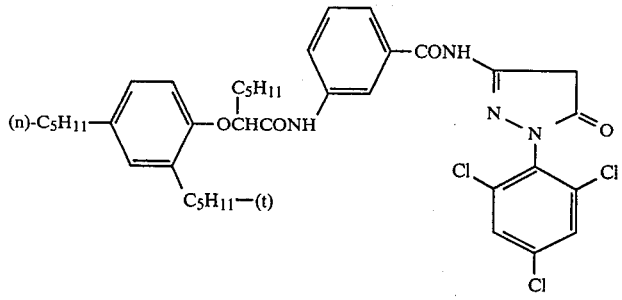

Ultraviolet Ray Absorbing Agent UV-1

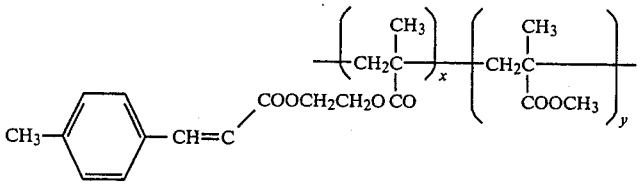

x/y = 7/3 (ratio by weight)

Hardener H-1

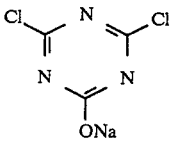

Sample 102

A sample was produced by the same manner as in Sample 101, except that the emulsion for the red-sensitive high speed layer $RL_3$ in Sample 101 was replaced with a silver iodobromide emulsion having a silver iodide content of 7.0% by mol prepared by the same manner and Coupler C-1 and Coupler C-2 were reduced in an amount of 5%, respectively, to correct slightly different gradation.

Sample 103

A sample was produced by the same manner as in Sample 101, except that the emulsions for the red-sensitive low speed layer and the red-sensitive medium speed layer ($RL_1$ and $RL_2$) in Sample 101 were replaced with silver iodobromide emulsions having the same particle size and a silver iodide content of 6.5% by mol, respectively, which were prepared by the same manner, respectively, and Coupler C-1 and Coupler C-2 were increased in an amount of 10% in $RL_1$ and 15% in $RL_2$, respectively, in order to adjust soft gradation.

Sample 104

A sample was produced by the same manner as in Sample 101, except that the emulsions for the red-sensitive low speed layer and the red-sensitive medium speed layer ($RL_1$ and $RL_2$) were replaced with silver halide emulsions having the same particle size and a silver iodide content of 6.5% by mol, respectively, which were prepared by the same manner, respectively, and Coupler D-3 was reduced in an amount of 25% in order to adjust soft gradation.

Sample 105

A sample was produced by the same manner as in Sample 101, except that the Coupler D-3 in $RL_1$ and $RL_2$ in Sample 101 was replaced with an equimolar amount of Coupler E-1.

Sample 106

A sample was produced by the same manner as in Sample 102, except that the Coupler D-3 in $RL_1$ in Sample 102 was replaced with an equimolar amount of Coupler E-1.

Sample 107

A sample was produced by the same manner as in Sample 101, except that $RL_1$, $RL_2$ and $RL_3$ in Sample 101 were replaced with those in Samples 102, 103 and 105. Namely:

The 3rd Layer: Red-Sensitive Low Speed Emulsion Layer ($RL_1$)

Silver iodobromide emulsion (monodisperse emulsion having silver iodide: 6.5% by mol and average particle size: 0.65μ), coating amount of silver 1.65 g/m$^2$ Sensitizing Dye I: $6\times10^{-5}$ mol per mol of silver Sensitizing Dye II: $1.5\times10^{-5}$ mol per mol of silver Coupler C-1: 0.066 mol per mol of silver Coupler E-2: 0.003 mol per mol of silver Coupler E-1: 0.002 mol per mol of silver The 4th Layer: Red-Sensitive Medium Speed Emulsion Layer ($RL_2$)

Silver iodobromide emulsion (polydisperse emulsion having silver iodide: 6.5% by mol and average particle size: 0.85μ), coating amount of silver: 1.25 g/m$^2$ Sensitizing Dye I: $4\times10^{-5}$ mol per mol of silver Sensitizing Dye II: $1\times10^{-5}$ mol per mol of silver Coupler C-1: 0.040 mol per mol of silver Coupler C-2: 0.017 mol per mol of silver Coupler E-2: 0.0025 mol per mol of silver Coupler E-1: 0.0015 mol per mol of silver The 5th Layer: Red-Sensitive High Speed Emulsion Layer ($RL_3$)

Silver iodobromide emulsion (polydisperse emulsion having silver iodide: 7.0% by mol and average particle size: 1.2μ), coating amount of silver: 1.85 g/m$^2$
Sensitizing Dye I: $2.5\times10^{-5}$ mol per mol of silver
Sensitizing Dye II: $0.6\times10^{-5}$ mol per mol of silver
Coupler C-1: 0.0076 mol per mol of silver
Coupler C-2: 0.0095 mol per mol of silver
Coupler E-2: 0.002 mol per mol of silver Samples 101 to 107 were exposed to light wedge with white light. When they were subjected to development processing as described in the following, nearly the same sensitivity and gradation were obtained.

RMS values of cyan dye images in these samples were determined. The determination of RMS values was carried out by the same method as that of determining RMS value in Example 1. Further, MTF values of cyan images in frequency of 7 and 30/mm were measured.

In order to determine the degree of the interimage effect of the red-sensitive emulsion layer to the green-sensitive emulsion layer, they were firstly uniformly exposed to green light and thereafter exposed to light wedge by red light. They were then subjected to the following development processing. Maximum and minimum densities of the negatives were measured, and a difference of densities thereof was calculated. The larger the difference of densities is, the greater the interimage effect is. Results of them are collected in Table 5.

The development processing used here was carried out at 38° C. as follows.

1. Color Development: 3 min and 15 sec
2. Bleach: 6 min and 30 sec
3. Water Wash: 3 min and 15 sec
4. Fix: 6 min and 30 sec
5. Water Wash: 3 min and 15 sec
6. Stabilization: 3 min and 15 sec Compositions of processing solutions used in each process are as follows.

Color Developing Solution
Sodium Nitrilotriacetate: 1.0 g
Sodium Sulfite: 4.0 g
Sodium Carbonate: 30.0 g
Potassium Bromide: 1.4 g
Hydroxylamine Sulfate: 2.4 g
4-(N-Ethyl-N-β-hydroxyethylamino)-2-methylaniline Sulfate: 4.5 g
Water to make: 1 liter
Bleaching Solution
Ammonium Bromide: 160.0 g
Aqueous Ammonia (28%): 25.0 ml
Ethylenediaminetetraacetate-Sodium Iron Salt: 130 g
Glacial Acetic Acid: 14 ml
Water to make: 1 liter
Fixing Solution
Sodium Tetrapolyphosphate: 2.0 g
Sodium Sulfite: 4.0 g
Ammonium Thiosulfate (70%): 175.0 ml
Sodium Bisulfite: 4.6 g
Water to make: 1 liter
Stabilizing Solution
Formalin: 8.0 ml
Water to make: 1 liter

TABLE 5

| Sample | Silver Iodide Content of Red-Sensitive High Speed Emulsion | Silver Iodide Content of Red-Sensitive Medium and Low Speed Emulsions (medium speed) | (low speed) | DIR Compound in Red-Sensitive Medium and Low Speed Eulsions | RMS Value (cyan image) D = 0.1 + Fog | D = 1.0 + Fog | MTF Value (cyan image) 7 Lines/mm | 30 Lines/mm | Difference between the Maximum Density and the Minimum Density (magenta image) |
|---|---|---|---|---|---|---|---|---|---|
| 101 | 10.5 | 3.5 | 4.0 | D-3 | 0.016 | 0.014 | 1.08 | 0.30 | 0.33 |
| 102 | 7.0 | 3.5 | 4.0 | D-3 | 0.023 | 0.015 | 1.08 | 0.29 | 0.33 |
| 103 | 10.5 | 6.5 | 6.5 | D-3 | 0.020 | 0.014 | 1.07 | 0.29 | 0.32 |
| 104 | 10.5 | 6.5 | 6.5 | D-3 | 0.021 | 0.014 | 1.01 | 0.26 | 0.28 |
| 105 | 10.5 | 3.5 | 4.0 | E-1 | 0.025 | 0.017 | 0.92 | 0.20 | 0.22 |
| 106 | 7.0 | 3.5 | 4.0 | E-1 | 0.031 | 0.018 | 0.91 | 0.21 | 0.23 |
| 107 | 7.0 | 6.5 | 6.5 | E-1 | 0.030 | 0.021 | 0.89 | 0.20 | 0.21 |

Table 5 is a comparison of Samples 102 and 101 or Samples 106 and 105, which shows the RMS value in the low density part becomes small and the granularity is improved by replacing the high speed emulsion with the high iodine emulsion. Further, according to the comparison of Samples 105 and 101 or Samples 106 and 102, when the diffusible DIR compound is used in the low speed layer instead of the prior DIR coupler E-1, granularity in the low density area of the high speed layer part is improved and sharpness and interimage effect represented by the MTF value are improved. According to comparison of Samples 103 or 104 and 101, granularity is further improved by reducing the iodine content in the emulsions for the medium speed layer or the low speed layer. It is believed that this phenomenon is originated from high development activity of the low iodine emulsion.

This example shows that according to the process of the present invention, it is possible to obtain silver halide color light-sensitive materials having high sensitivity which are excellent in granularity, sharpness and color reproduction.

EXAMPLE 5

A multilayer color light-sensitive material: Sample 201 consisting of layers having the following compositions was produced on a polyethylene terephthalate film base.

Sample 201

The 1st Layer: Antihalation Layer (AHL)
The same as that of AHL in Sample 101.
The 2nd Layer: Intermediate Layer (ML)
The same as that of Sample 101.
The 3rd Layer: Red-Sensitive Low Speed Emulsion Layer ($RL_1$)
Silver iodobromide emulsion (polydisperse emulsion having silver iodide: 4% by mol and average particle sive: 0.75μ), coating amount of silver: 2.2 g/m$^2$
Sensitizing Dye I: $5\times10^{-5}$ mol per mol of silver
Sensitizing Dye II: $1.25\times10^{-5}$ mol per mol of silver
Coupler C-1: 0.04 mol per mol of silver
Coupler C-2: 0.02 mol per mol of silver Coupler E-2: 0.003 mol per mol of silver
Coupler D-3: 0.0025 mol per mol of silver
The 4th Layer: Intermediate Layer (ML)
The same as the 2nd layer
The 5th Layer: Green-Sensitive Low Speed Emulsion Layer ($GL_1$)
Silver iodobromide emulsion (polydisperse emulsion having silver iodide: 4% by mol and average particle size: 0.70μ), coating amount of silver: 1.90 g/m²
Sensitizing Dye III: $3.0\times10^{-5}$ mol per mol of silver
Sensitizing Dye IV: $1.0\times10^{-5}$ mol per mol of silver
Coupler M-1: 0.045 mol per mol of silver
Coupler D-3: 0.0015 mol per mol of silver
Coupler E-3: 0.004 mol per mol of silver
The 6th Layer: Yellow Filter Layer (YFL)
The same as YFL in Sample 101
The 7th Layer: Blue-Sensitive Low Speed Emulsion Layer ($BL_1$)
Silver iodobromide emulsion (monodisperse emulsion having silver iodide: 4% by mol and average particle size: 0.80μ), coating amount of silver: 1.0 g/m²
Coupler Y-1: 0.30 mol per mol of silver
Coupler D-3: 0.025 mol per mol of silver
The 8th Layer: Intermediate Layer (ML)
The same as the 2nd layer
The 9th Layer: Red-Sensitive High Speed Emulsion Layer ($RL_2$)
The same as $RL_3$ in Sample 101
The 10th Layer: Intermediate Layer
The same as in the 2nd layer
The 11th Layer: Green Sensitive High Speed Emulsion Layer ($GL_2$)
The same as $GL_3$ in Sample 101, except that the emulsion for $GL_3$ in Sample 101 was replaced with a silver iodobromide emulsion having the same particle size and a silver iodide content of 10.5% by mol prepared by the same manner.
The 12th Layer: Yellow Filter Layer
The same as the 6th layer
The 13th Layer: Blue-Sensitive High Speed Emulsion Layer ($BL_2$)
The same as $GL_3$ in Sample 101, except that the emulsion for $GL_3$ in Sample 101 was replaced with a silver iodobromide emulsion having the same particle size and a silver iodide content of 10.5% by mol prepared by the same manner.
The 14th Layer: The 1st Protective Layer ($PL_1$)
The same as $PL_1$ in Sample 101
The 15th Layer: The 2nd Protective Layer ($PL_2$)
The same as $PL_2$ in Sample 101

Sample 202

A sample was produced by the same manner as in Sample 201, except that the emulsions for the red-sensitive low speed layer, the green-sensitive low speed layer and the blue-sensitive low speed layer were replaced with silver iodobromide emulsions having the same particle size and a silver iodide content of 6.5% by mol, respectively, which were prepared by the same manner, respectively, and Coupler D-3 was replaced with 0.85 time by mol of Coupler E-1 so as to adjust gradation, respectively.

Sample 203

A sample was produced in the same manner as in Sample 201, except that the emulsions for the red-sensitive high speed emulsion layer, the green-sensitive high speed emulsion layer and the blue-sensitive high speed emulsion layer in Sample 201 were replaced with silver iodobromide emulsions having the same particle size, respectively, and a silver iodide content of 7.5% by mol which were prepared by the same manner, respectively.

When the RMS value and the MTF value of magenta images and the interimage effect from the green-sensitive emulsion layer to the red-sensitive emulsion layer were measured by the same methods as in Example 1, the magenta images in Sample 201 had good granularity. Particularly, the granularity in the low density parts was excellent and a good MTF value and a good interimage effect were shown.

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material, comprising:
a support base having thereon:
a first, color-sensitive, silver halide emulsion layer having a sensitivity with respect to light;
a second, color-sensitive, silver halide emulsion layer having a sensitivity with respect to light which is greater than the sensitivity with respect to light of the first sensitive layer, the second layer having the same color sensitivity properties as the first layer, the silver halide of the second layer having a silver iodide content in the range of 9% by mol to 15% by mol; and
a DIR compound which releases a compound selected from the group consisting of diffusible development inhibitors having a degree of diffusion of 0.4 or more as a releasing group and precursors thereof by a coupling reaction, the DIR compound being present in a color-sensitive, silver halide emulsion layer other than the second layer, which also has the same color sensitivity properties as the first layer.

2. A material as claimed in claim 1, wherein the first layer and the second layer are both blue-sensitive layers.

3. A material as claimed in claim 1, wherein both the first layer and the second layer are green-sensitive layers.

4. A material as claimed in claim 1, wherein both the first layer and the second layer are red-sensitive layers.

5. A material as claimed in claim 1, wherein the DIR compound is present in a layer containing silver halide having a silver iodide content of 5% by mol or less, which has the same coupler sensitivity properties as the first layer.

6. A material as claimed in claim 5, wherein the layer containing the DIR compound contains a silver halide having an iodide content in the range of 2% to 4% by mol.

7. A material as claimed in claim 6, wherein the second layer contains a silver halide having a silver iodide content in the range of 10% to 14% by mol.

8. A material as claimed in claim 1, wherein the DIR compound is present in an amount in the range of 0.0001 to 0.1 mol per mol of silver halide.

9. A material as claimed in claim 8, wherein the DIR compound is present in an amount in the range of 0.001 to 0.05 mol per mol of silver halide.

10. A material as claimed in claim 9, wherein the DIR compound is represented by the general formula (I):

$$A(Y)_m \quad (I)$$

wherein A is a coupler component, m is 1 or 2, and Y is a group which is attached to a coupling position of the coupler component A and is released by a reaction with an oxidation product of a color developing agent, which is a development inhibitor having a degree of diffusion of 0.4 or more as releasing group or a compound capable of releasing a development inhibitor.

* * * * *